US010989483B2

(12) United States Patent
Espersen et al.

(10) Patent No.: US 10,989,483 B2
(45) Date of Patent: Apr. 27, 2021

(54) THERMOSIPHON WITH MULTIPORT TUBE AND FLOW ARRANGEMENT

(71) Applicant: Aavid Thermalloy, LLC, Laconia, NH (US)

(72) Inventors: Morten Søegaard Espersen, Bologna (IT); Maria Luisa Angrisani, Bologna (IT); Marco La Foresta, Bologna (IT); Sukhvinder S. Kang, Concord, NH (US)

(73) Assignee: Aavid Thermalloy, LLC, Laconia, NH (US)

( * ) Notice: Subject to any disclaimer, the term of this patent is extended or adjusted under 35 U.S.C. 154(b) by 0 days.

(21) Appl. No.: 15/786,926

(22) Filed: Oct. 18, 2017

(65) Prior Publication Data

US 2018/0038653 A1 Feb. 8, 2018

Related U.S. Application Data

(63) Continuation of application No. PCT/US2016/028342, filed on Apr. 20, 2016.
(Continued)

(51) Int. Cl.
*F28D 15/04* (2006.01)
*F28D 15/02* (2006.01)
(Continued)

(52) U.S. Cl.
CPC ..... *F28D 15/043* (2013.01); *F28D 1/05366* (2013.01); *F28D 15/0233* (2013.01);
(Continued)

(58) Field of Classification Search
CPC .. F28D 15/043; F28D 15/046; F28D 15/0266; F28D 15/0233; F28D 15/0275;
(Continued)

(56) References Cited

U.S. PATENT DOCUMENTS 5,082,051 A * 1/1992 Ando ..... F28D 1/05366 165/110
5,613,552 A * 3/1997 Osakabe ..... F28D 15/0233 165/104.21
(Continued)

FOREIGN PATENT DOCUMENTS

CA 2658316 A1 * 1/2008 ..... F17C 5/06
CN 102083297 A 6/2011
(Continued)

OTHER PUBLICATIONS

DE 102006014462 English Machine Translation (Year: 2007).*
(Continued)

*Primary Examiner* — Len Tran
*Assistant Examiner* — Jenna M Hopkins
(74) *Attorney, Agent, or Firm* — Wolf, Greenfield & Sacks, P.C.

(57) ABSTRACT

A thermosiphon device includes one or more flat multiport tube structures having at least one section that defines a plurality of flow channels and at least one web that extends from the section in a plane of the flat multiport tube structures. The flow channels may function as condensing channels, e.g., in a counterflow device, or as evaporation channels. A multiport tube structure may include two sections that each define a plurality of flow channels and the two sections may be joined by a web that extends between the sections in the plane of the multiport tube structure. The sections may function as condensing channels, as evaporation channels, or one section may function as a set of evaporation channel and the other section may function as a set of condensing channels. Multiport tube sections may alternately function as a vapor supply path or liquid return path.

31 Claims, 80 Drawing Sheets

Related U.S. Application Data

(60) Provisional application No. 62/150,465, filed on Apr. 21, 2015.

(51) Int. Cl.
*F28D 1/053* (2006.01)
*F28F 1/12* (2006.01)

(52) U.S. Cl.
CPC ..... *F28D 15/0266* (2013.01); *F28D 15/0275* (2013.01); *F28D 15/0241* (2013.01); *F28F 1/128* (2013.01)

(58) Field of Classification Search
CPC ..... F28D 1/05366; F28D 1/05391; F28D 1/05383; H01L 23/427; H01L 23/3672
See application file for complete search history.

(56) References Cited

U.S. PATENT DOCUMENTS 5,655,598 A * 8/1997 Garriss ..... F28D 15/0266 165/104.14
5,713,413 A * 2/1998 Osakabe ..... F28D 15/0233 165/104.33
5,924,481 A * 7/1999 Tajima ..... F28D 15/0266 165/104.21
6,257,324 B1 * 7/2001 Osakabe ..... F28D 15/0233 165/104.21
6,357,517 B1 * 3/2002 Osakabe ..... H01L 23/427 165/104.21
6,561,262 B1 * 5/2003 Osakabe ..... F28D 15/0266 165/104.21
6,575,230 B1 * 6/2003 Kadota ..... F28D 15/0233 165/104.21
6,681,843 B2 * 1/2004 Sugito ..... F28D 15/0233 165/104.21
7,121,332 B2 10/2006 Förster et al.
8,405,992 B2 * 3/2013 Yesin ..... H01L 23/427 361/700
9,007,771 B2 * 4/2015 Agostini ..... F28D 1/0435 361/689
9,113,578 B2 * 8/2015 Cottet ..... H05K 7/20672
9,113,579 B2 * 8/2015 Cottet ..... H05K 7/20672
9,897,383 B2 * 2/2018 Yesin ..... F28D 1/05383
9,964,362 B2 * 5/2018 Agostini ..... F28D 15/0233
2005/0024831 A1 * 2/2005 Phillips ..... F28D 15/025 361/700
2005/0205239 A1 * 9/2005 Take ..... F28D 15/025 165/80.3
2007/0284093 A1 * 12/2007 Bhatti ..... F28D 15/0266 165/104.33
2008/0047690 A1 * 2/2008 Muramatsu ..... F28D 15/0233 165/104.14
2008/0169086 A1 * 7/2008 Hu ..... F28D 1/05366 165/80.4
2009/0056916 A1 * 3/2009 Yesin ..... F28D 1/05383 165/104.21
2009/0323276 A1 * 12/2009 Mongia ..... G06F 1/203 361/679.52
2010/0000233 A1 * 1/2010 Groothuis ..... F17C 5/06 62/50.2
2010/0005832 A1 * 1/2010 Grozinger ..... F28D 15/0266 62/515
2010/0089546 A1 * 4/2010 Perez ..... B21D 53/08 165/41
2010/0270010 A1 * 10/2010 Agostini ..... F28D 15/0233 165/104.27
2010/0277870 A1 * 11/2010 Agostini ..... F28D 1/0435 361/701
2011/0127011 A1 * 6/2011 Agostini ..... F28D 15/0266 165/104.21
2011/0265975 A1 * 11/2011 Koivuluoma ..... H01L 23/427 165/67
2011/0272121 A1 * 11/2011 Suzuki ..... H01L 23/473 165/104.19
2012/0097369 A1 * 4/2012 Agostini ..... F28D 1/05391 165/104.21
2012/0111553 A1 * 5/2012 Tsoi ..... F28D 15/0233 165/185
2013/0075076 A1 * 3/2013 Agostini ..... F28F 9/00 165/287
2013/0104592 A1 * 5/2013 Cottet ..... H05K 7/20672 62/419
2013/0107455 A1 * 5/2013 Cottet ..... H05K 7/20672 361/694
2013/0221774 A1 * 8/2013 Agostini ..... H02K 9/18 310/64
2013/0233014 A1 * 9/2013 Agostini ..... F28D 15/0266 62/515
2013/0255920 A1 * 10/2013 Yamauchi ..... F28D 15/02 165/104.21
2013/0258594 A1 * 10/2013 Gradinger ..... F28D 15/02 361/700
2013/0292092 A1 * 11/2013 Omori ..... F28F 3/00 165/104.11
2013/0292094 A1 * 11/2013 Omori ..... F28D 15/025 165/104.21
2014/0090814 A1 4/2014 Kondou et al.
2014/0116653 A1 * 5/2014 Lange ..... F21V 29/006 165/104.21
2014/0223945 A1 * 8/2014 Rahl ..... F28D 1/0461 62/235.1
2014/0313672 A1 * 10/2014 Tuomola ..... H05K 7/20336 361/700
2015/0029667 A1 * 1/2015 Szczesny ..... F28D 15/0275 361/700
2015/0173242 A1 * 6/2015 Blomberg ..... F28D 15/0266 62/259.2
2016/0033182 A1 * 2/2016 Joardar ..... F28D 1/024 62/507
2016/0054075 A1 * 2/2016 Taras ..... F28D 1/0391 165/173
2016/0061532 A1 * 3/2016 Espersen ..... F28D 15/0266 165/104.21
2016/0146552 A1 * 5/2016 Tutunoglu ..... H05K 7/20809 165/173
2016/0299544 A1 * 10/2016 Wu ..... H05K 7/20336
2017/0045305 A1 * 2/2017 Contet ..... F28F 1/02
2017/0167798 A1 * 6/2017 Espersen ..... F28D 15/0266
2018/0051938 A1 2/2018 Espersen et al.

FOREIGN PATENT DOCUMENTS

CN 102980427 A 3/2013
CN 103363818 A 10/2013
CN 203719499 U 7/2014
CN 104937364 A 9/2015
DE 102006014462 A1 * 10/2007 ..... F28D 1/05383
DE 19758886 B4 * 9/2017 ..... F25B 39/028
EP 2444770 A1 * 4/2012 ..... F28D 1/05391
EP 2988578 A1 * 2/2016 ..... F28F 9/0278
JP 2004-012011 A 1/2004
WO WO 97/14925 A1 4/1997
WO WO-2013183136 A1 * 12/2013 ..... F25B 39/02
WO WO 2014/116351 A1 7/2014
WO WO-2014126634 A1 * 8/2014 ..... F28D 1/05383

OTHER PUBLICATIONS

International Search Report and Written Opinion for International Application No. PCT/US2016/028342, dated Sep. 20, 2016.
International Preliminary Report on Patentability for International Application No. PCT/US2016/028342, dated Nov. 2, 2017.

* cited by examiner

THERMOSIPHON WITH MULTIPORT TUBE AND FLOW ARRANGEMENT

RELATED APPLICATIONS

This Application is a continuation of International Patent Application Serial No. PCT/US2016/028342, filed Apr. 20, 2016, which claims priority under 35 U.S.C. § 119(e) to U.S. Provisional Application Ser. No. 62/150,465, filed Apr. 21, 2015. The entire contents of these applications are incorporated herein by reference in their entirety.

BACKGROUND OF THE INVENTION

1) Field of Invention

This invention relates generally to thermosiphon devices and other heat transfer devices that employ a two-phase fluid for cooling.

2) Description of Related Art

Thermosiphon devices are widely used for cooling systems, such as integrated circuits and other computer circuitry. For example, U.S. Patent Publication 2013/0104592 discloses a thermosiphon cooler used to cool electronic components located in a cabinet or other enclosure.

SUMMARY OF THE INVENTION

One aspect of the invention provides a thermosiphon device including an evaporator section arranged to receive heat and evaporate a liquid, and a condenser section arranged to transfer heat from evaporated liquid to a surrounding environment to condense the evaporated liquid. At least one flat multiport tube structure may be employed in the device and include one or more functional sections of the device, such as evaporator and condenser channels. For example, a flat multiport tube structure may have a first section defining one or more flow channels, a second section defining one or more flow channels, and a web that extends between the first and second sections in a plane of the multiport tube structure. Thus, the web may connect the first and second sections together while providing at least some degree of thermal isolation between the two. For example, the web may include one or more gaps (e.g., areas where the web is removed) to help limit thermal transfer between the first and second sections, help reduce weight or cost, etc.

The thermal isolation and/or physical separation of the first and second sections provided by the web may allow the sections to perform different, or the same, functions in the thermosiphon device. In some embodiments, the first section may define one or more evaporation channels, and the second section may define one or more evaporation channels, one or more condensing channels, or a liquid return path of the evaporator section. Alternately, or in addition, the first section may define one or more condensing channels, and the second section may define one or more evaporation channels, one or more condensing channels, or a vapor supply path of the condenser section. As a result, different functional portions of the thermosiphon device may be formed as part of a single multiport tube structure, helping to ease assembly, simplify device design, and/or enhance device operation. Where multiple tube structures are used, the tube structures may provide a variety of different functions. Thus, the multiport tube structure may allow for greater flexibility in design since various functional features can be incorporated into tube structure or structures used in the device.

In some devices, the evaporator section may include at least one evaporation channel arranged to receive heat and evaporate a liquid in the at least one evaporation channel and a liquid return path for delivering condensed liquid to the at least one evaporation channel. In one embodiment, the evaporation channels and liquid return path may be combined into a multiport tube structure, e.g., the at least one evaporation channel and the liquid return path may be part of a flat multiport tube structure in which the first section defines the at least one evaporation channel and the second section defines the liquid return path. Similarly, a condenser section may include at least one condensing channel arranged to transfer heat from evaporated liquid to a surrounding environment to condense the evaporated liquid and a vapor supply path for delivering evaporated liquid to the at least one condensing channel. The at least one condensing channel and the vapor supply path may be part of a flat multiport tube structure in which the second section defines at least one condensing channel and the first section defines the vapor supply path. At least one manifold may fluidly connect the at least one evaporation channel with the vapor supply path, and fluidly connect the at least one condensing channel with the liquid return path. For example, a manifold may include an outer wall that defines an interior cavity and a separation wall positioned in the interior cavity to separate the interior cavity into a vapor chamber and a liquid chamber. The separation wall may be positioned in the manifold such that the at least one evaporation channel and the vapor supply path are in fluid communication with the vapor chamber, and the at least one condensing channel and the liquid return path are in fluid communication with the liquid chamber. Two or more multiport tube structures may be provided as part of the evaporator or condenser section, e.g., to increase a heat capacity of the system.

In another embodiment, a single multiport tube structure may define portions of both the condenser and evaporator sections. For example, a single flat multiport tube structure may have a first section that defines at least one evaporation channel and a vapor supply path, and a second section that defines a liquid return path and at least one condensing channel. As a result, a single tube structure may form a complete thermosiphon device, and a plurality of such flat multiport tube structures may be provided in a thermosiphon device, if desired.

In some embodiments, a flat multiport tube structure may include one or more lateral webs that extend outwardly from the first or second section in a plane of the flat multiport tube structure. The lateral web(s) may provide thermal transfer structure (e.g., exchange heat with a surrounding environment), or provide protection for portions of the thermosiphon device. In addition, or alternately, the flat multiport tube structure may include three or more sections that define flow channels, and the sections may be connected such that adjacent sections have a web extending between the sections. This may allow a multiport tube structure to incorporate several different functional elements. For example, a first section of the multiport tube structure may define a plurality of condenser channels, the second section may define the vapor supply path, and the third section may define a plurality of condenser channels.

In another aspect of the invention, a thermosiphon device may include one or more flat multiport tube structures having a first section that defines one or more flow channels, and a web that extends laterally away from the first section in a plane of the multiport tube structure. The first section may define a plurality of evaporation channels or a plurality of condenser channels. The web may be useful in defining an insertion depth of an end of the first section into a manifold or other structure to which the multiport tube structure is fluidly coupled. For example, the web may act as a stop to define the insertion depth, which may be important to control or influence flow of liquid or vapor from or into the first section. In one case, a liquid return path may need to be positioned below a set of evaporation channels in a manifold to ensure that liquid enters the liquid return path rather than the evaporation channels. In such a case, the web on a multiport tube that defines the evaporation channels may cut or otherwise formed to define a gap that sets a proper insertion depth of the first section into a manifold when the web contacts the manifold. In some cases, a multiport tube structure may have first and second webs that extend laterally away from opposite sides of the first section in a plane of the multiport tube structure, e.g., to enlarge a heat transfer area. Multiport tube structures having this arrangement may be employed as part of the evaporator section, e.g., to provide evaporation channels, and/or as part of a condenser section, e.g., to provide condenser channels. When employed to provide condenser channels, the condenser section may operate in a counterflow mode (where vapor moves generally upwardly in the channels while condensed liquid travels generally downwardly) or in a loop mode (where vapor and condensed liquid move generally in a same direction). Such multiport tube structures may also be used for other purposes, such as fluid connecting conduits or other pathways that are not designed or intended to transfer significant amounts of heat with respect to a fluid in the conduit.

These and other aspects of the invention will be apparent from the following description. Also, it should be appreciated that different aspects of the invention may be combined in a variety of different ways.

BRIEF DESCRIPTION OF THE DRAWINGS

The accompanying drawings, which are incorporated in and form a part of the specification, illustrate select embodiments of the present invention and, together with the description, serve to explain the principles of the inventions. In the drawings.

DETAILED DESCRIPTION

Figure 1:
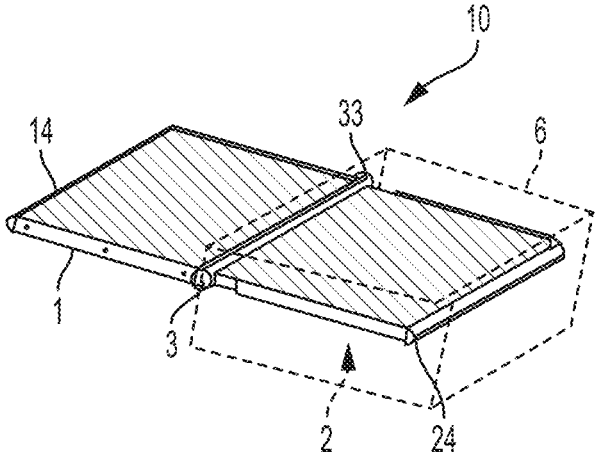
FIG. 1 is a perspective view of a thermosiphon device in an illustrative embodiment that incorporates aspects of the invention.

Aspects of the invention are not limited in application to the details of construction and the arrangement of components set forth in the following description or illustrated in the drawings. Other embodiments may be employed and aspects of the invention may be practiced or be carried out in various ways. Also, aspects of the invention may be used alone or in any suitable combination with each other. Thus, the phraseology and terminology used herein is for the purpose of description and should not be regarded as limiting.

FIG. 1 shows an illustrative embodiment of a thermosiphon device 10, e.g., used to cool electronics devices in a closed cabinet or other enclosure 6. That is, as is understood by those of skill in the art, one or more evaporator sections 2 of the device 10 may be positioned in a sealed enclosure 6 along with electronics or other heat-generating devices to be cooled. One or more condensing sections 1 may be positioned outside of the sealed enclosure 6 and dissipate heat received from the evaporator section(s) 2, e.g., to air in an environment outside of the sealed enclosure 6. A flange 33 on a manifold 3 or elsewhere in the device 10 may be engaged with an opening of the sealed enclosure, thereby sealing the enclosure 6 and defining a dividing point between portions inside of the enclosure 6 and an environment outside of the enclosure. By providing the evaporator section(s) 2 inside the sealed enclosure 6 and the condenser section(s) 1 outside of the enclosure 6, devices in the enclosure 6 may be cooled while being contained in an environment protected from external conditions, e.g., protected from dirt, dust, contaminants, moisture, etc. Of course, use of a thermosiphon device with a sealed enclosure is not required, e.g., the device may be used in a completely open system in which heat generating devices to be cooled are thermally coupled to one or more evaporator section(s) 2 of the device 10. Also, the embodiment of FIG. 1 shows the thermosiphon device 10 arranged at a relatively shallow angle to the horizontal, but the device 10 may be oriented in different ways, e.g., vertically or other angles to the horizontal, and may be arranged to operate in a variety of different positions as discussed in more detail below. Also, the device 10 need not be flat as in FIG. 1, but may be arranged in a bent configuration such as shown in FIG. 2 or in other ways.

Figure 2:
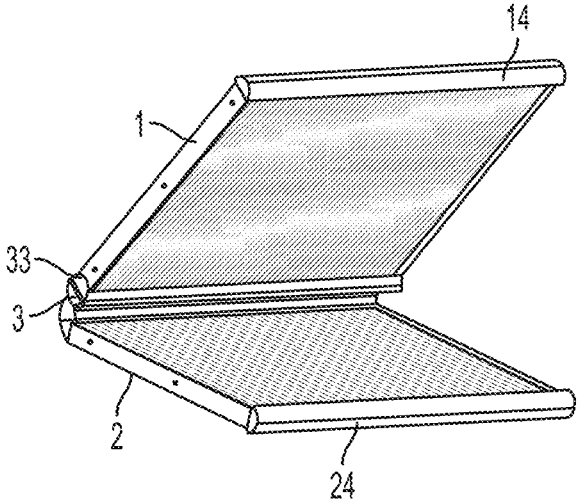
FIG. 2 shows a thermosiphon device in another illustrative embodiment having a bent configuration.
Figure 3:
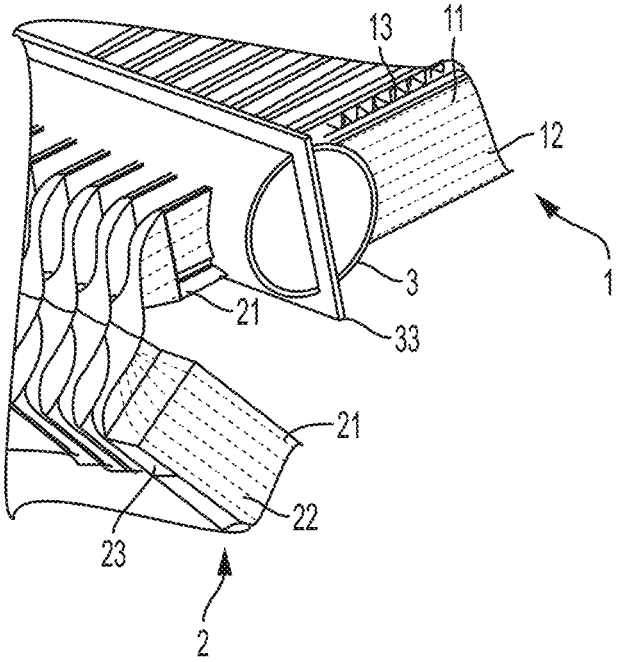
FIG. 3 shows a close up view of the FIG. 2 embodiment.

FIG. 3 shows a close up view of a portion of the thermosiphon device 10 of FIG. 2. In simplified form, the thermosiphon device 10 operates to cool heat generating devices by receiving heat at the evaporator section(s) 2 such that liquid in evaporation channels 22 boils or otherwise vaporizes. Heat may be received at the evaporation channels 22 by warm air (heated by the heat generating devices) flowing across a thermal transfer structure 23 that is thermally coupled to the evaporation channels 22 or in other ways, such as by a direct conductive path, one or more heat pipes, a liquid heat exchanger, etc. Vapor flows upwardly from the evaporation channels 22 into a manifold 3, and then into a vapor supply path 11 of a condenser section 1. The vapor continues to flow upwardly in the vapor supply path 11 until reaching a turnaround 14 (see FIG. 2) of the condenser section 1. At this point, the vapor flows downwardly into one or more condensing channels 12 of the condenser section 1, where the vapor condenses to a liquid and flows downwardly into the manifold 3. Heat removed from the vapor during condensation may be transferred to thermal transfer structure 13 coupled to the condensing channels 12, e.g., one or more fins conductively coupled to the condenser section 1 adjacent the condensing channels 12. In turn, heat may be removed from the thermal transfer structure 13 by cool air flowing across the structure 13, by a liquid bath, a liquid heat exchanger, refrigerant coils, or other arrangement. The condensed liquid flows downwardly from the condensing channels 12 into the manifold 3 and then into a liquid return path 21 of an evaporator section 2 until reaching a turnaround 24 (see FIG. 2) of the evaporator section 2. The liquid then enters an evaporator channel 22 and the process is repeated.

In accordance with an aspect of the invention, the condenser section 1 and/or evaporator section 2 may be arranged as a flat multiport tube structure in which functionally different channel sections are attached to each other by a flat web that extends between the channel sections in the plane of the multiport tube structure. For example, the evaporator section may include one or more flat multiport tube structures that each have at least one evaporation channel section joined to a liquid return path section by a flat web that extends in a plane of the multiport tube structure. Alternately, or in addition, the condenser section may include one or more flat multiport tube structures that each have at least one condensing channel section joined to a vapor supply path section by a flat web that extends in a plane of the multiport tube structure. By having the different sections joined by a flat web, heat transfer between the sections may be minimized, particularly if the web is made very thin, discontinuous and/or of a material having a relatively low thermal conductivity. Reduced heat transfer may provide advantages, such as helping to ensure proper thermal performance of the thermosiphon device 10 and suitable vapor and liquid flow. For example, reduced heat transfer between a liquid return path section and an evaporation channel section may help maintain working fluid in liquid form in the liquid return path, thereby helping ensure proper flow circulation in the thermosiphon device. Similar is true for the condensing channel section and the vapor supply path, i.e., reduced heat transfer may help maintain working fluid in vapor form in the vapor supply path. Moreover, by combining different functional sections of the evaporator and/or condenser sections into a single part, manufacture and assembly can be simplified.

Figure 4:
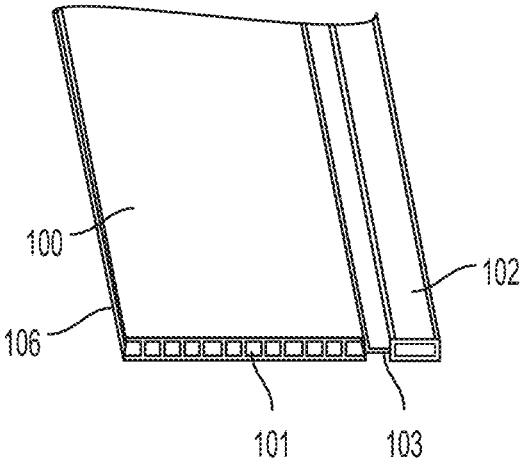
FIG. 4 shows an illustrative embodiment of a multiport tube structure having a connecting web.
Figure 5:
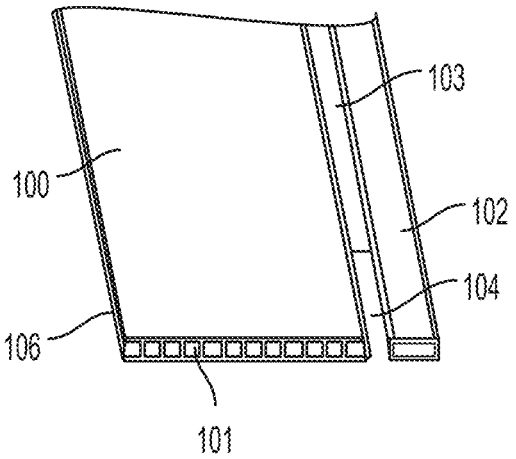
FIG. 5 shows a modified version of the FIG. 4 embodiment.

FIGS. 4 and 5 show illustrative embodiments of a flat multiport tube structure that may be employed as part of an evaporator or condenser section in accordance with aspects of the invention. In FIG. 4, the multiport tube 100 includes a first section 101 and a second section 102 that are joined by a flat web 103 that extends between the sections 101, 102 in a plane of the multiport tube 100. The first section 101 in this embodiment includes multiple flow channels, and could function as a set of evaporation channels 22 or condensing channels 12 or other flow conduit. The second section 102 includes a single channel, and could function as a liquid return path 21 or vapor supply path 11 or other flow conduit. Of course, it will be understood that any suitable number of channels may be employed in the first and/or second sections 101, 102. The web 103 may have any suitable width, thickness and/or length, and may be made of any suitable material, which may be different than the material used to form the first and/or second sections 101, 102. For example, a wider and/or thinner web 103 may help reduce heat transfer between the first and second sections 101, 102. As another example, portions of the web 103 may be removed, e.g., punched out, to provide a gap between the first and second sections 101, 102 while still maintaining a mechanical connection between the sections 101, 102. FIG. 5 shows an arrangement in which a gap 104 is provided by removal of a portion of the web 103. While in the FIG. 5 embodiment a portion of the web 103 at an end of the multiport tube 100 is removed, other portions of the web 103 may be removed, such as portions positioned anywhere along a length of the web 103. Thus, one or more gaps 104 may be provided in the web 103, whether to reduce weight, help control heat transfer, reduce cost, and/or other purposes. Also, as discussed more below, a web 103 is not limited to a single flat element that extends between the first and second sections 101, 102 at a center point in the thickness dimension of the multiport tube structure 100 as shown in FIGS. 4 and 5. Instead, for example, the web 103 may be positioned so as to be flush with one or both side surfaces of the first and second sections 101, 102, e.g., so that the first and second sections 101, 102 and the web 103 define a continuous flat, planar surface. Also, two or more webs 103 may be provided, if desired, e.g., with one web 103 positioned flush with a top side surface of the first and second sections 101, 102 and another web 103 positioned flush with a bottom side surface of the first and second sections 101, 102. Where two or more webs 103 are provided and if the webs 103 define a potential flow channel, the flow channel is not employed by the device 10, e.g., the flow channel may contain only air, insulation or other material that is not working fluid for the device 10. An arrangement in which the multiport tube structure 100 includes webs 103 positioned flush at both side surfaces of the first and second sections 101, 102 may be convenient for manufacture, e.g., because the multiport tube structure 100 may initially be made as a conventional multiport tube, and a portion of the tube that defines one or more flow channels may be arranged to function as the web 103 section, e.g., portions of the tube at the web section may be notched, removed, otherwise altered or simply not employed as a flow channel for the device. Moreover, the web(s) 103 need not be completely flat as shown, but may be corrugated, have a surface texture or be arranged in other ways.

Figure 6:
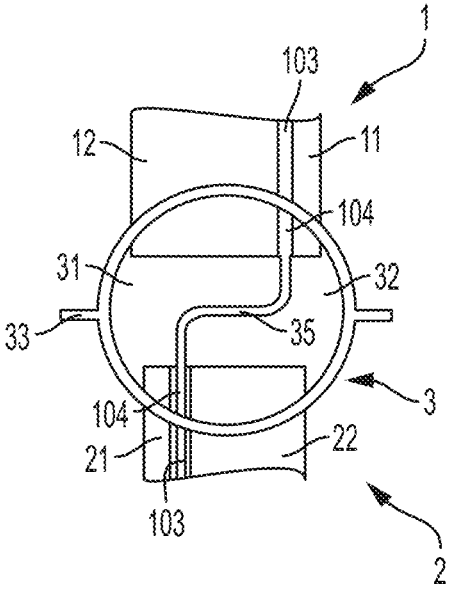
FIG. 6 shows an end view of a manifold coupled to condenser and evaporator sections including multiport tube structures.
Figure 7:
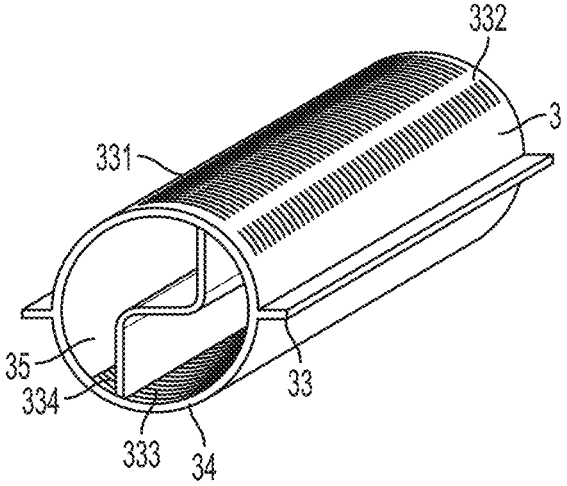
FIG. 7 shows a perspective view of the manifold in FIG. 6.

In accordance with another aspect of the invention, providing a gap 104 in a web 103 near an end of a multiport tube 100 may also help define a relationship between the multiport tube 100 and a manifold 3 or other structure to which the multiport tube 100 is attached. For example, FIG. 6 shows an illustrative embodiment of a device 10 that includes a condenser section 1 and an evaporator section 2 that include a multiport tube like that shown in FIG. 5. The manifold ends of the multiport tube structure of the condenser and evaporator sections 1, 2 are inserted into openings of the outer wall of the manifold 3 so that the gap 104 is positioned in the manifold 3. A separation wall 35 in the manifold 3 divides the internal space of the manifold 3 into a vapor chamber 32 and a liquid chamber 31, and ends of the separation wall 35 extend into the gaps 104 of the multiport tubes 100. As a result, the evaporation channels 22 and the vapor supply path 11 are fluidly connected to the vapor chamber 32, and the condensing channels 12 and the liquid return path 21 are fluidly connected to the liquid chamber 31. FIG. 7 shows a perspective view of the manifold 3 without the condenser and evaporator sections 1, 2 engaged with the manifold 3. As can be seen, the outer wall 34 of the manifold 3 has openings 331, 332, 333, 334 to receive portions of the manifold end of the condenser and evaporator sections 1, 2. That is, the openings 331 are arranged to receive a first section 101 of a multiport tube 100 that defines the condensing channels 12, the openings 332 are arranged to receive a second section 102 of a multiport tube 100 that defines the vapor supply path 11, the openings 333 are arranged to receive a first section 101 of a multiport tube 100 that defines the evaporation channels 22, and the openings 334 are arranged to receive a second section 102 of a multiport tube 100 that defines the liquid return path 21. The openings 331 and 332 for each multiport tube 100 are separated by a solid portion of the outer wall 34 which contacts a leading end of the web 103 of each multiport tube 100 so as to limit the extent to which the manifold end of the multiport tube 100 can be inserted into the manifold 3. Thus, the insertion depth of each multiport tube structure 100 can be relatively easily defined by establishing a desired length for the gap 104, i.e., the multiport tube 100 can be inserted into the manifold 3 until the web 103 contacts the outer wall 43 of the manifold 3.

Figure 8:
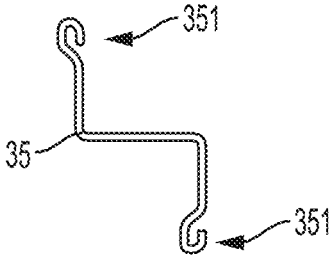
FIG. 8 shows a separation wall in one embodiment.
Figure 9:
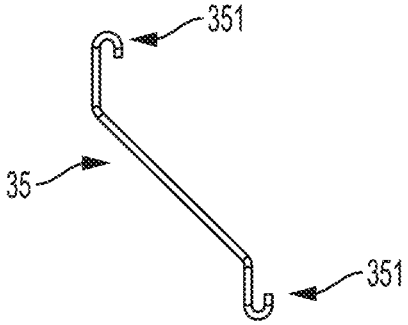
FIG. 9 shows a separation wall in another embodiment.
Figure 10:
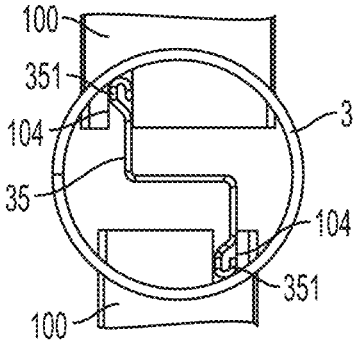
FIG. 10 shows an end view of a manifold incorporating the separation wall of FIG. 8.

While the separation wall 35 in the FIGS. 6 and 7 embodiment is arranged as a plate having an S shape with straight ends, the separation wall 35 can be arranged in other ways. For example, FIG. 8 shows a separation wall 35 that includes a folded barb or hairpin clip 351 at ends of the wall 35. FIG. 9 shows another separation wall 35 that includes a folded barb or hairpin clip 351 at ends of the wall 35, but the wall 35 in this case has a different overall shape, e.g., a lazy Z shape. Of course, other shapes for a separation wall 35 are possible. FIG. 10 shows an embodiment similar to that in FIGS. 6 and 7, but employing a separation wall 35 like that in FIG. 8. As can be seen, the barb or clip 351 at ends of the wall 35 engage with the multiport tube structures 100 at the gap 104 so that the multiport tube structures 100 are held in place by friction with the barb or clip 351. This may help hold the multiport tube structures 100 in place in preparation for brazing or other process to securely join the multiport tube structures 100 with the manifold 3.

Figure 11:
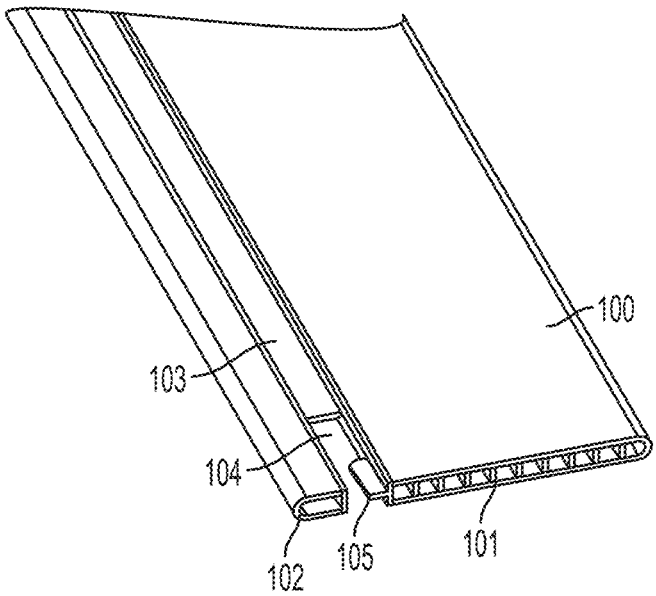
FIG. 11 shows a multiport tube structure having a connecting web and tooth.
Figure 12:
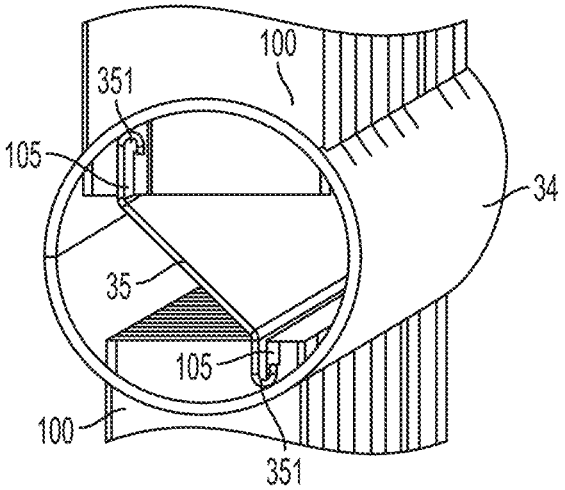
FIG. 12 shows an end view of a manifold incorporating the separation wall of FIG. 9.
Figure 13:
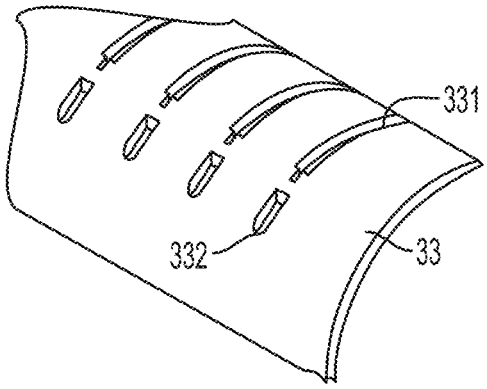
FIG. 13 shows a section of a manifold arranged to receive the multiport tube structure of FIG. 11.

In another aspect of the invention, a multiport tube structure 100 may include a tooth or other engagement feature to help secure the multiport tube structure 100 in place with respect to a manifold 3 or other element. For example, FIG. 11 shows an illustrative embodiment that includes a tooth 105 formed in the gap 104 at the manifold end of a multiport tube structure 100. In this case, the tooth 105 is formed by removing a section of the web 103 to form both the gap 104 and the tooth 105, but other arrangements are possible, such as welding or otherwise attaching a tooth, barb, tab or other engagement element to the multiport tube structure 100. As can be seen in FIG. 12, the tooth 105 may engage a portion of a separation wall 35 or other component so that the manifold end of the multiport tube structure 100 is captured in engagement with the manifold 3 or other component. In this embodiment, the separation wall 35 is arranged like that shown in FIG. 9, and a distal end of the hairpin clip 351 is captured on a proximal side of the tooth 105 so that the multiport tube structure 100 is held in place. As a result, the manifold end of each multiport tube structure 100 may be inserted into the manifold 3 until the clip 351 is captured at the proximal end of the tooth 105, ensuring the multiport tube structure 100 is properly positioned in the manifold 3. As can be seen in FIG. 13, openings 331 in the manifold 3 may be arranged to receive the tooth 105, e.g., to have a relatively small slit extending from the main opening 331 to allow the tooth 105 to pass through.

Figure 14:
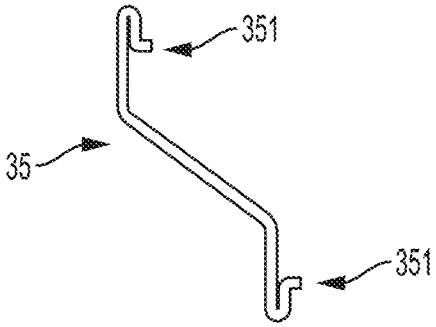
FIG. 14 shows a separation wall in another embodiment that includes a barb or clip with a laterally extending element.
Figure 15:
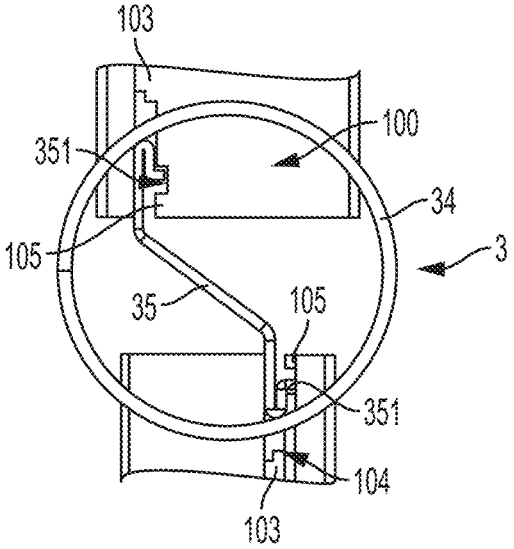
FIG. 15 shows an end view of a manifold incorporating the separation wall of FIG. 14.
Figure 16:
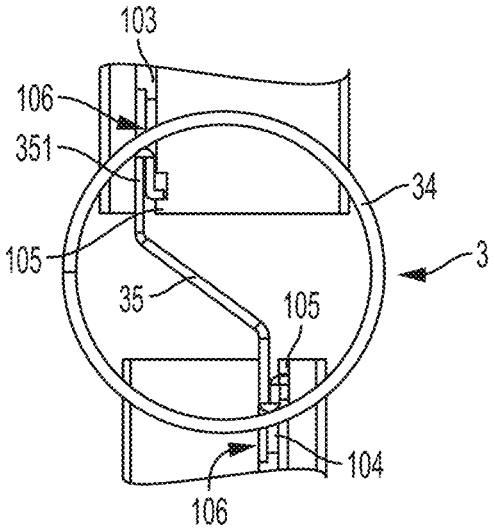
FIG. 16 shows the manifold of FIG. 15 with the multiport tube structures positioned for attachment to the manifold.
Figure 17:
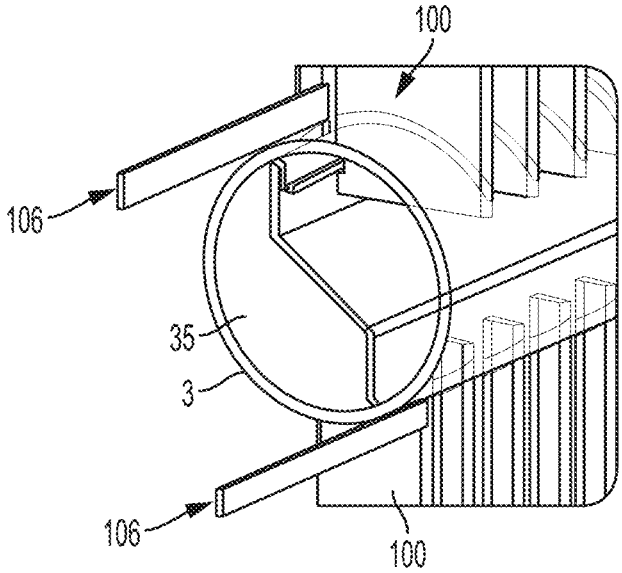
FIG. 17 shows the manifold of FIG. 16 with spacer elements in place.

As noted above, the separation wall 35 and clips or barbs 351 may be arranged in other ways. FIG. 14 shows another illustrative embodiment in which the clips or barbs 351 include a laterally extending portion at a distal end. As can be seen in FIG. 15, a tooth 105 and gap 104 of a multiport tube 100 may be arranged so that the laterally extending portion of the clip or barb 351 is captured on a proximal side of the tooth 105, thereby latching the multiport tube structure 100 in engagement with the manifold 3. As also shown in this embodiment, the gap 104 is made relatively long so that the web 13 does not contact the outer wall 34 of the manifold 3 when the multiport tube structure 100 is properly positioned relative to the manifold 3 with the laterally extending portion of the clip or barb 351 in contact with the tooth 105. Instead, the gap 104 is sized so that jig or spacer elements 106 can be received into the gap 104 at a location outside of the manifold inner space, as can be seen in FIGS. 16 and 17. The spacer elements 106 in this embodiment are arranged as rectangular bars that may be arranged to define the position of multiple multiport tube structures 100 relative to a manifold 3. After brazing or other attachment of the multiport tube structures 100 to the manifold 3 is complete, the spacer elements 106 may be removed, or the elements 106 may be secured in place as well.

Figure 18:
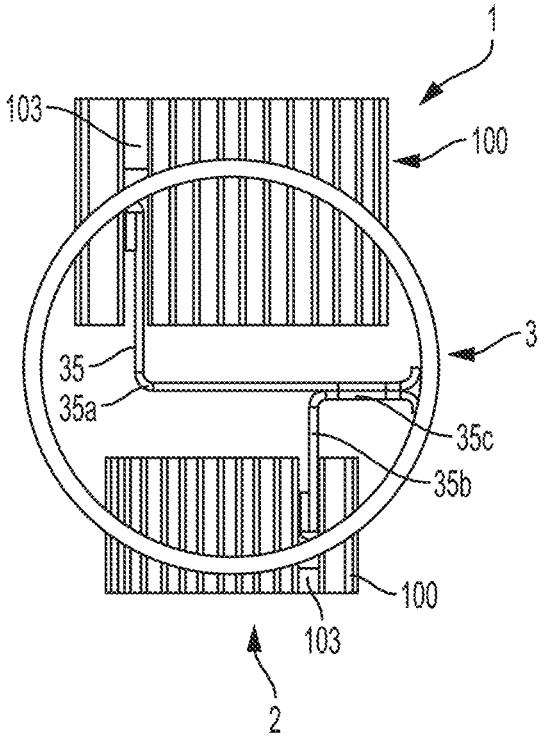
FIG. 18 shows an end view of a manifold incorporating another separation wall embodiment.

FIG. 18 shows another arrangement for a separation wall 35 that in this embodiment is made of two parts 35*a*, 35*b* that are joined together. One or more openings 35*c* may be provided in the separation wall 35, e.g., along a section where the parts 35*a*, 35*b* are joined together, so that liquid or vapor (in this case liquid) may pass from the condenser section 1 to the evaporator section 2.

Figure 19:
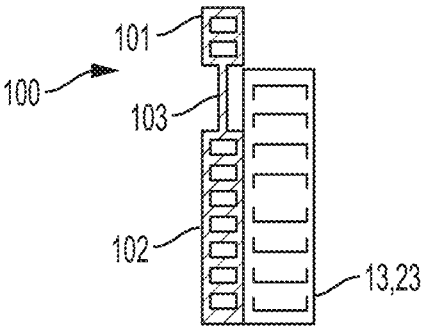
FIGS. 19-22 show embodiments of a multiport tube structure incorporating thermal transfer structure.
Figure 20:
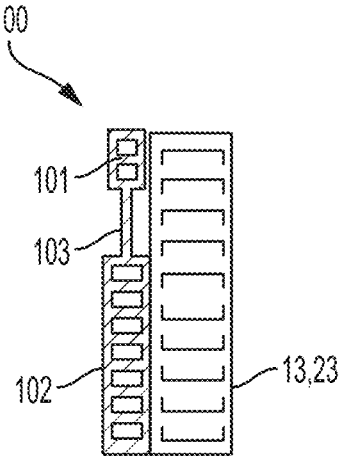
Figure 21:
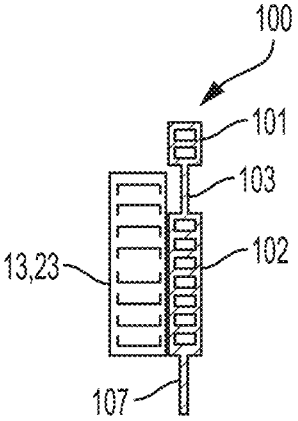
Figure 22:
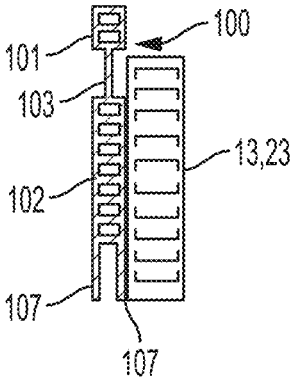

As mentioned above, a multiport tube structure 100 may have thermal transfer structure, such as fins, pins, studs or other structure to aid in heat transfer between a portion of the multiport tube structure 100 and a surrounding environment. For example, FIG. 19 shows a cross sectional view of a multiport tube structure 100 that includes first and second sections 101, 102 joined by a web 103. Here again, the web 103 is shown extending between first and second sections 101, 102 at a midpoint of a thickness of the first and second sections 101, 102, but such an arrangement is not required. Instead, the web 103 may be positioned at either side surface of the first and second sections 101, 102, may have a thickness equal to the first and second sections 101, 102, may extend at an angle relative to the plane of the multiport tube structure 100 (e.g., so as to extend the thermal pathway of the web 103 while not increasing an overall width of the structure 100), may be corrugated or have another non-flat shape, and others. Thermal transfer structure, such as fins 13, 23, are in thermal contact with the second section 102, which may function as condensing channels 12 or evaporating channels 22. So as to reduce heat transfer with respect to the first section 101, the thermal transfer structure 13, 23 stops short of, and does not contact, the first section 101. FIG. 20 shows a similar arrangement, except that the first section 101 is made thinner than the second section 102, or at least has a surface nearest the thermal transfer structure 12, 23 that is offset from the plane of the surface of the second section 102 to which the thermal transfer structure is attached. This way, a gap is present between the thermal transfer structure 13, 23 and the first section 101, allowing the thermal transfer structure 13, 23 to have a larger size and yet still avoid contact with the first section 101. FIG. 21 shows an arrangement similar to FIG. 19 except that the multiport tube structure 100 includes a flat web 107 that extends outwardly from the second section 102 in a plane of the multiport tube structure 100. This web 107 may serve as thermal transfer structure, e.g., a fin to transfer heat with respect to a surrounding environment, and/or may help protect the thermal transfer structure 13, 23. That is, the thermal transfer structure 13, 23 may be relatively fragile such that portions of the thermal transfer structure 13, 23 can be bent or otherwise damaged with contact. The web 107 may help prevent such contact. FIG. 22 shows another arrangement similar to FIG. 21, except that the multiport tube 100 includes a pair of flat webs 107 that extend away from the second section 102 in a plane of the multiport tube 100. In this embodiment, the webs 107 are positioned so as to be flush with a respective side surface of the first and second sections 101, 102, but could be arranged in other ways. Also, the thermal transfer structure 13, 23 may be thermally connected to one of the flat webs 107, which may aid in thermal transfer.

Figure 23:
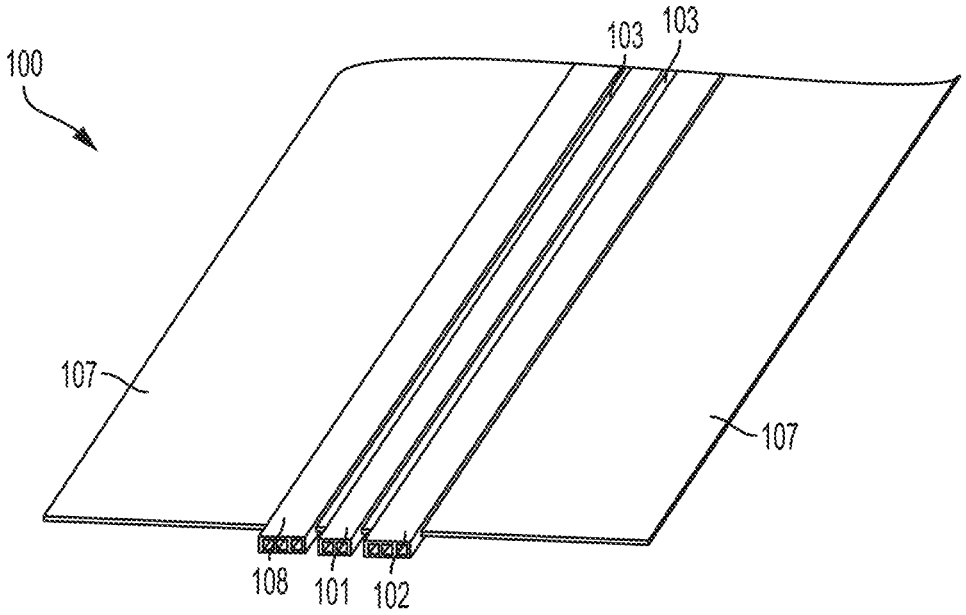
FIG. 23 shows an illustrative embodiment of a multiport tube structure having a three sections joined by connecting webs and having lateral webs.

While in the embodiments above, the multiport tubes 100 included only first and second sections 101, 102 arranged to carry fluid, embodiments are not limited in this regard. For example, FIG. 23 shows a multiport tube structure 100 that includes second and third sections 102, 108 that are joined to a first section 101 by respective webs 103. As noted above, such an arrangement may be useful where at least some degree of thermal isolation between the first section 101 and the second and third sections 102, 108 is desired. It should also be understood that each section 101, 102, 108 may include any suitable number of channels, e.g., 1, 2, 3, 5, 10, 20, etc. This embodiment also includes flat webs 107 that extend outwardly from the second and third sections 102, 108. These webs 107 may aid in thermal transfer, provide strength and/or perform other functions.

Figure 24:
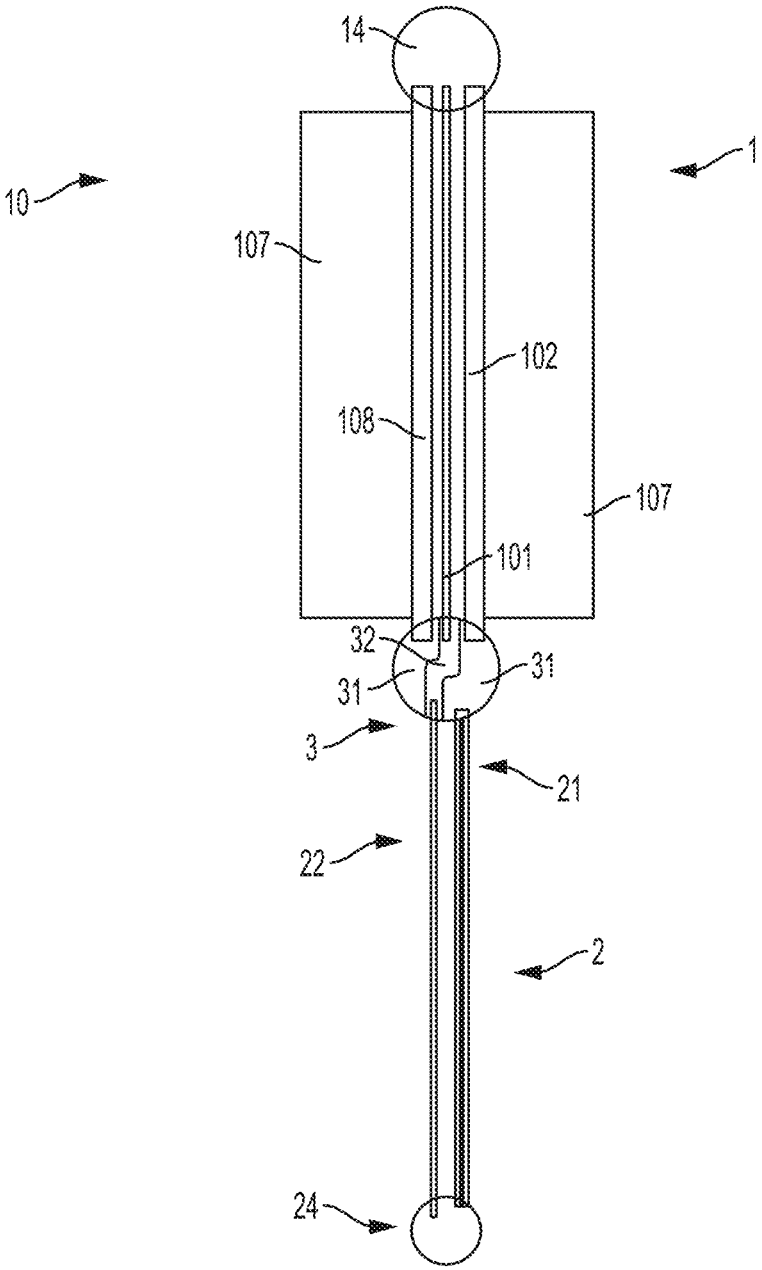
FIG. 24 shows a thermosiphon device incorporating the multiport tube structure of FIG. 23.

FIG. 24 shows an illustrative embodiment that employs a multiport tube structure 100 like that in FIG. 23 in the condenser section 1. In this example, the first section 101 of the multiport tube structure 100 functions as a vapor supply path 11 and provides working vapor to a turnaround 14 (which may be a tubular manifold that connects to multiple multiport tube structures 100). The vapor is then distributed to the second and third sections 102, 108 which function as condensing channels 12. Condensed working fluid, i.e., liquid, passes downwardly into liquid chambers 31 of the manifold 3 and to a liquid return path 21 of the evaporator section 2. The liquid is delivered to a turnaround 24 (which may be a tubular manifold that connects to multiple evaporation channels 22 and liquid return paths 21), which supplies evaporator channels 22 with working fluid in liquid form. Heat received by the working fluid evaporates the liquid, and the vapor travels upwardly to a vapor chamber 32 of the manifold and to the first section 101. The evaporation channels 22 and liquid return path 21 may be arranged in any suitable way, e.g., may include one or more multiport tube structures like that in FIG. 5, a single flow channel conduit, etc.

Figure 25:
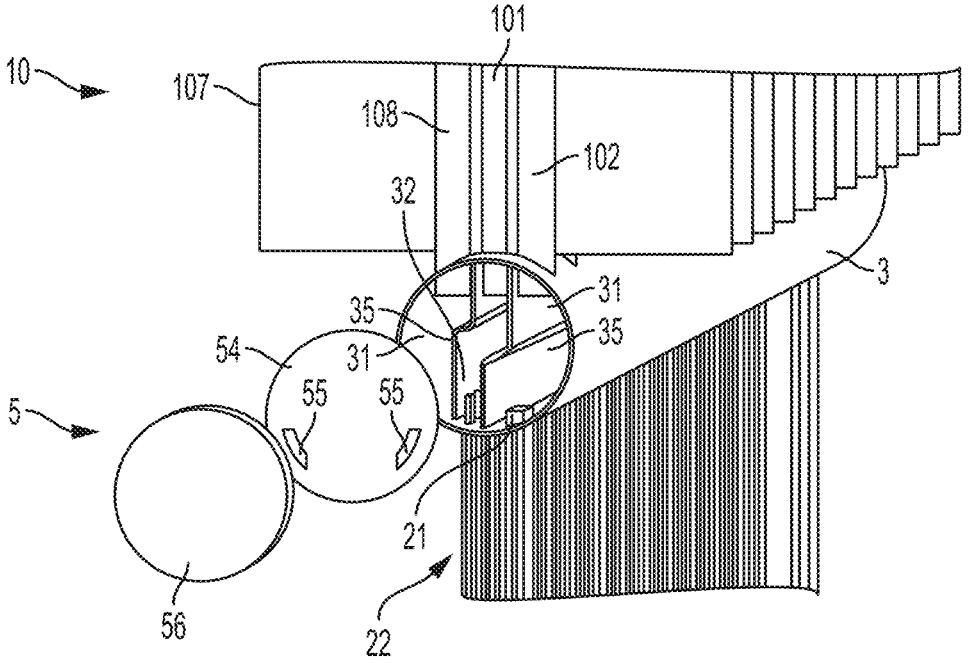
FIG. 25 shows an end view of a manifold of the FIG. 24 embodiment along with a cap structure.

FIG. 25 shows a close up view of the manifold 3 of the FIG. 24 embodiment. As described above, the internal space of the manifold 3 is divided into three chambers, i.e., a vapor chamber 32 and two liquid chambers 31. Since in this embodiment the liquid return path 21 is connected only to the liquid chamber 31 on the right in FIG. 25, some provision must be made to fluidly connect the two liquid chambers 31. In accordance with an aspect of the invention, the manifold includes an end cap 5 that includes an inner plate 54 with first and second openings 55 and an outer plate 56. The inner plate 54 is attached inside the manifold 3 so as to sealingly engage the ends of the separation walls 35 and the inner side of the manifold outer wall 34 so as to isolate the vapor chamber 32 from the liquid chambers 31. The outer plate 56 is then attached to the end of the outer wall 34 of the manifold 3. Since the inner plate 54 is inset from the end of the manifold 3, a space is provided between the outer plate 56 and the inner plate 54 so that the openings 55 are fluidly connected to each other, thereby fluidly connecting the liquid chambers 31. In embodiments where a liquid return path 21 is connected to both liquid chambers 31, the openings 55 may be eliminated. In such a case, a relatively small opening may be provided in the inner plate 54 to allow fluid communication between the vapor chamber 32 and the space between the outer plate 56 and the inner plate 54. This opening allows for equalization of pressure in the space between the outer plate 56 and the inner plate 54 and the vapor chamber 32, which can help prevent bowing of the inner plate 54 due to pressure in the vapor chamber 32. This can help ensure the inner plate 54 maintains a suitable seal with the separation wall(s) 35.

Figure 26:
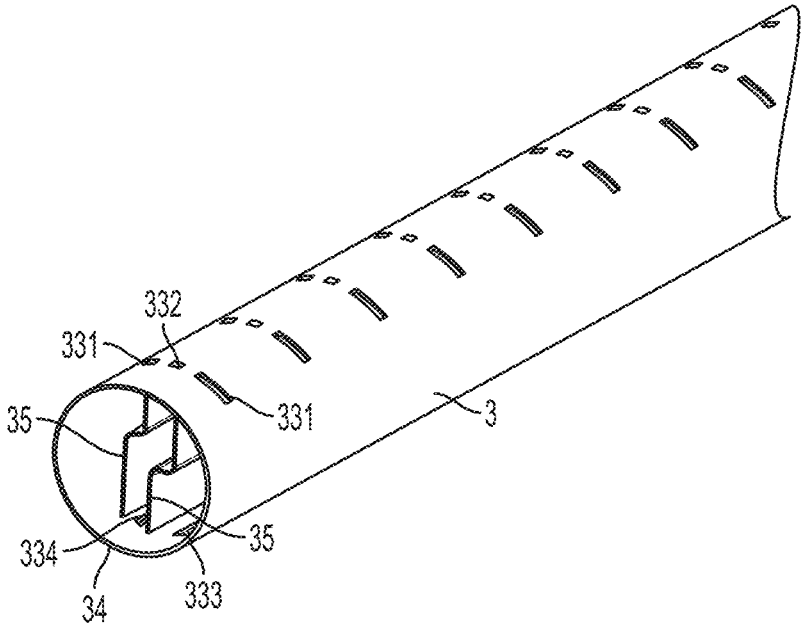
FIG. 26 shows the manifold of the FIG. 24 embodiment.

FIG. 26 shows a close up view of the manifold in the FIG. 24 embodiment. The separation walls 35 are inset from the end of the outer wall 34 of the manifold 3 by a distance that approximately defines the offset between the inner and outer plates 54, 56. That is, the inner plate 54 fits inside of the outer wall 34 and contacts the ends of the separation plates 35 so that the inner plate 54 is inset relative to the end of the outer wall 34. Thus, when the outer plate 56 is attached to the end of the outer wall 34, the outer plate 56 is separated from the inner plate 54 so that a chamber is defined between the inner and outer plates 54, 56. This chamber provides the fluid communication between the openings 55. The manifold is also shown as having openings 331, 332, 333, 334. Much like in the FIG. 7 embodiment, these openings respectively receive the first section 101 and second and third sections 102, 108 of the condenser section 1, the liquid return path 21 and the evaporation channels 22.

Figure 27:
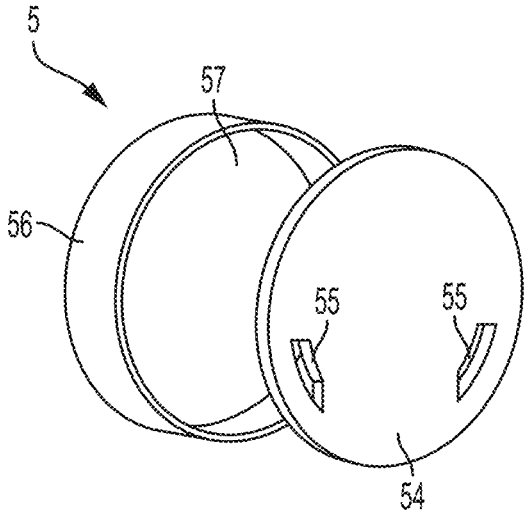
FIGS. 27 and 28 show an alternate end cap arrangement.
Figure 28:
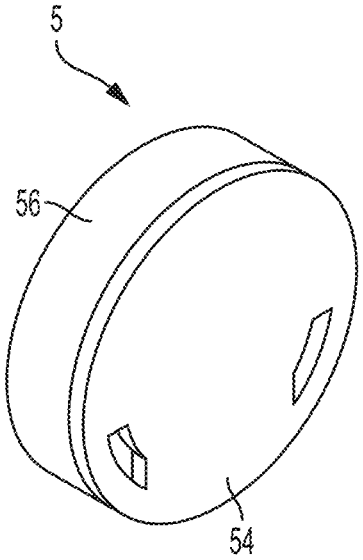

FIGS. 27 and 28 show an alternate embodiment for an end cap 5. In an embodiment where the separation wall(s) 35 in a manifold 3 extend so as to be flush with the end of the outer wall 34 of the manifold 3, the end cap 5 may be arranged differently from that described above. Specifically, if the separation wall(s) 35 are not inset from the end of the outer wall 34, the end cap 5 may be arranged to provide a flow path between the openings 55. In the illustrative embodiment of FIGS. 27 and 28, the inner plate 54 has a larger diameter than in the above embodiment (e.g., equal or greater than the diameter of the manifold 3), and the outer plate is arranged to include a cylindrical wall element 56 and a flat plate 57. As can be seen in FIG. 28, the inner plate 54 may be attached to the cylindrical wall element 56 so that the inner plate 54 is spaced from the flat plate 57. The inner plate 54 can then be attached to the ends of the outer wall 34 and the separation wall(s) 35 to close the manifold 3. In an embodiment where the openings 55 are eliminated, the inner plate 54 may have a small opening to allow fluid communication between the vapor chamber 32 and the space between the flat plate 57 and the inner plate 54, as discussed above.

Figure 29:
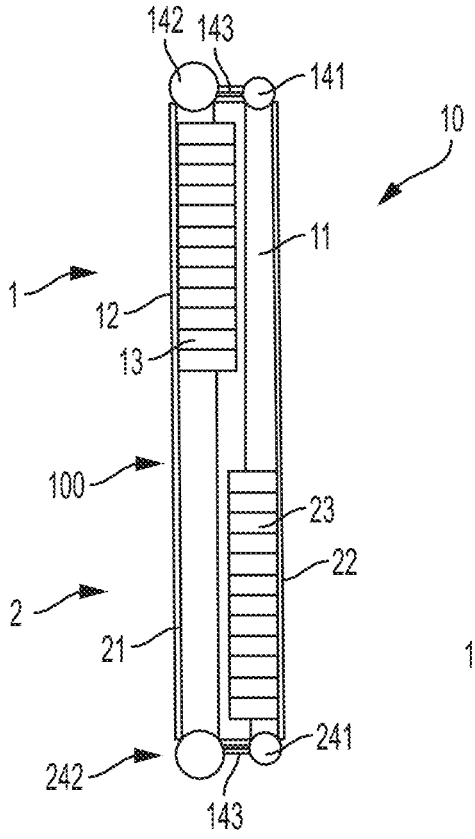
FIG. 29 shows a thermosiphon device in which a multiport tube structure defines portions of both an evaporator and condenser section.
Figure 30:
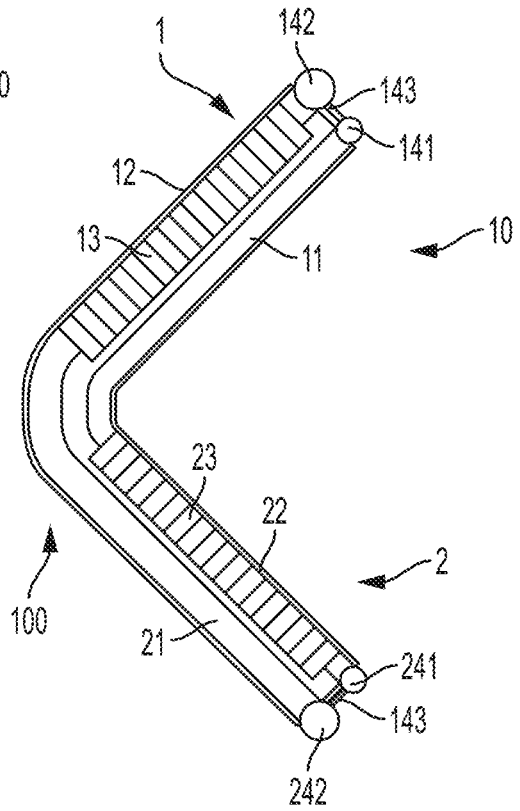
FIG. 30 shows a thermosiphon device similar to that of FIG. 29 but having a bent configuration.
Figure 31:
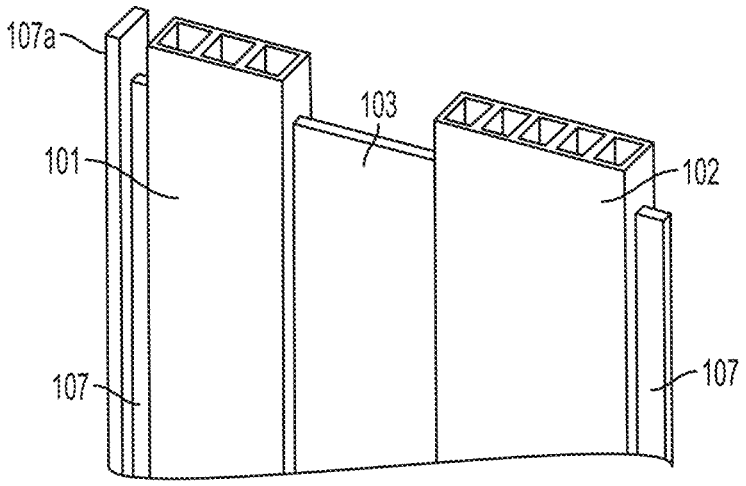
FIG. 31 shows a multiport tube structure for use in the FIGS. 29 and 30 embodiments.

In another illustrative embodiment, both a condenser section and an evaporator section may be made from a single multiport tube structure. Moreover, the condenser section may include a vapor supply path separate from one or more condensing channels, and the evaporator section may include a liquid return path that is separate from one or more evaporation channels. For example, FIG. 29 shows a thermosiphon device 10 that includes a multiport tube structure 100 that defines the condenser section 1 and the evaporator section 2. FIG. 30 shows essentially the same arrangement except that the multiport tube structure 100 is bent to form an angled device 10. FIG. 31 shows a perspective view of a multiport tube structure 100 that may be used to form the devices 10 in FIGS. 29 and 30. The first section 101 includes three channels in this embodiment and may form the vapor supply path 11 and the evaporator section 22. The second section 102 includes five channels in this embodiment and may form the condensing channels 12 and the liquid return path 21. Of course, other numbers of channels may be used as desired. The first and second sections 101, 102 are joined by a web 103 that extends in a plane of the multiport tube structure 100, and may be solid, include one or more gaps 104 (not shown) along its length, etc. As can be seen in FIGS. 29 and 30, thermal transfer structure 13, 23 is thermally coupled to portions of the first section 101 that defines the evaporation channels 22 and to portions of the second section 102 that defines the condensing channels 12. As described above, the thermal transfer structure 13, 23 may enhance heat transfer for the sections to which the structure 13, 23 is thermally coupled. The multiport tube structure 100 may include outer webs 107 that extend outwardly in the plane of the multiport tube structure 100 from the first and second sections 101, 102. These webs 107 may help transfer heat and/or provide protection for the thermal transfer structure 13, 23. The web 107 shown on the left in FIG. 31 includes a bumper section 107*a* that extends in a thickness direction of the multiport tube structure 100 and may help protect thermal transfer structure 13, 23. Of course, the webs 107 may be eliminated, altered in size and/or thickness and/or material, notched or selectively removed in sections, etc.

At opposite ends of the multiport tube structure 100, the first and second sections 101, 102 are fluidly coupled by turnarounds that are defined by manifolds 141, 142 for the condenser section 1 and manifolds 241, 242 for the evaporator section 2. The manifolds 141, 142 and 241, 242 may be fluidly coupled to each other by one or more conduits 143 so that vapor or liquid can pass.

Figure 32:
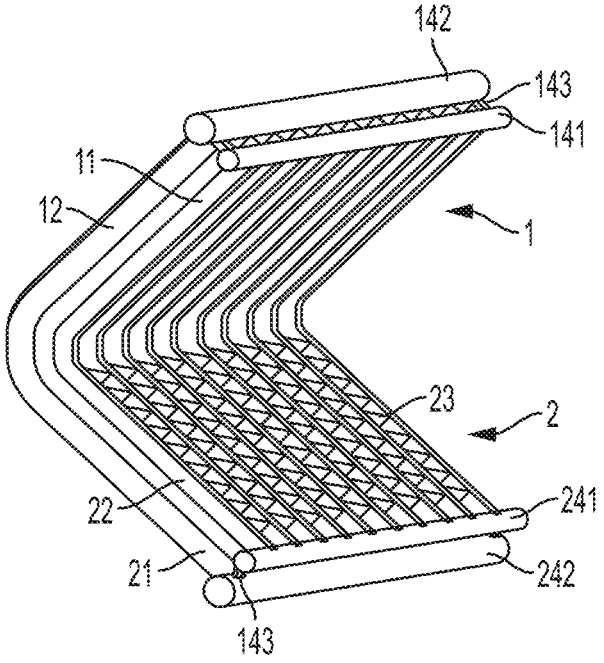
FIG. 32 shows a thermosiphon device like that of FIG. 30 and having multiple multiport tube structures.

FIG. 32 shows a perspective view of a thermosiphon device 10 arranged like that in FIG. 30, but has a plurality of multiport tube structures 100 arranged in parallel and communicating with the manifolds 141, 142 and 241, 242. Thermal transfer structure 23 may be thermally coupled to adjacent pairs of evaporation channels 22 and may be arranged to allow for air or other fluid flow between the multiport tube structures 100. Thermal transfer structure 13 may be similarly arranged for the condenser section 1, but cannot be seen in FIG. 32.

Figure 33:
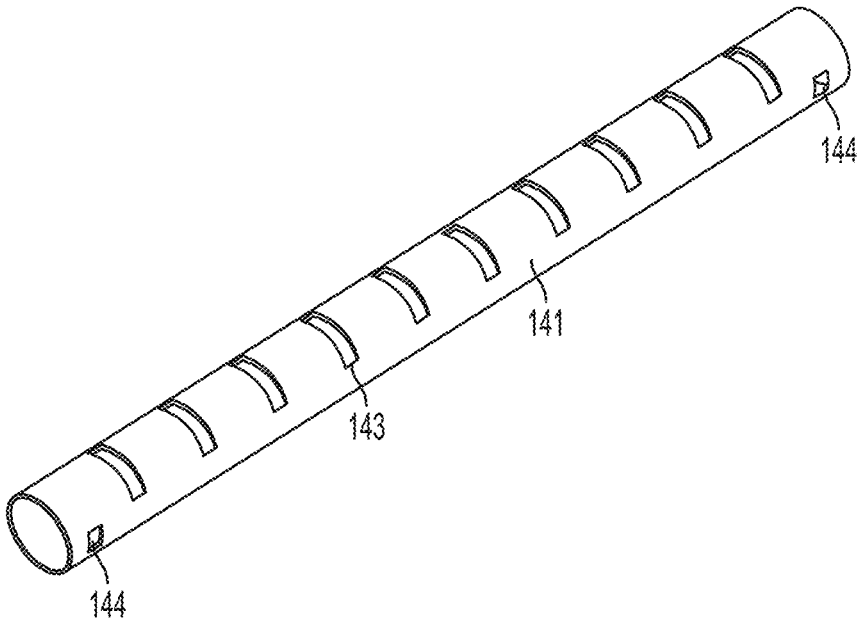
FIG. 33 shows a manifold of the FIG. 32 embodiment.

FIG. 33 shows one of the manifolds 141 of the FIG. 32 embodiment and illustrates how the manifold 141 may include a plurality of openings 143 to receive a manifold end of a multiport tube structure 100, and openings 144 that connect to a conduit 143 (such as a pipe) that provides fluid coupling between the manifold 141 and the manifold 142. The other manifolds 142, 241 and 242 may be similarly arranged.

Figure 34:
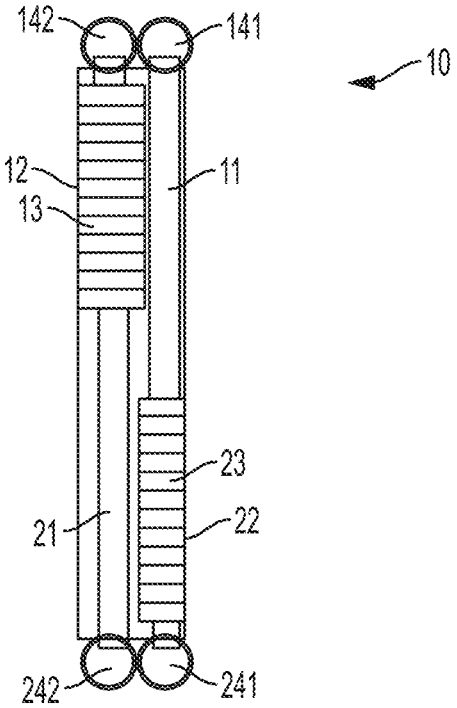
FIG. 34 shows a modified version of the device of FIG. 29 that omits conduits between manifolds.
Figure 35:
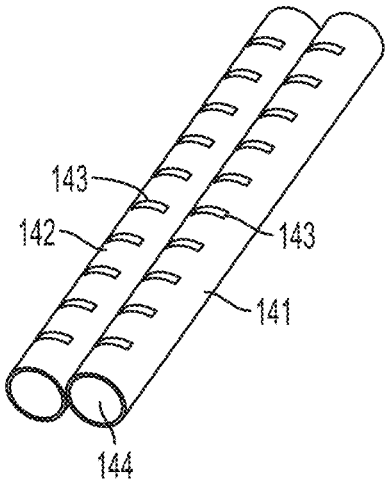
FIG. 35 shows a manifold arrangement for the embodiment of FIG. 34.

FIG. 34 shows an arrangement similar to that in FIG. 29, except that conduits 143 that provide fluid coupling between the manifolds 141, 142 and 241, 242 are eliminated. Instead, the manifolds 141, 142 and 241, 242 are butted up against each other so that the manifolds 141, 142 and 241, 242 may communicate directly through the openings 144. FIG. 35 illustrates how the manifolds 141, 142 may be joined together such that the openings 144 in each manifold are aligned to provide fluid communication between the manifolds 141, 142. While the embodiment of FIG. 34 has a flat or planar arrangement, the manifold arrangement may be employed in a bent configuration like that in FIG. 30 or other device 10 configurations. Of course, one potential benefit of the arrangement in FIG. 29 as compared to the FIG. 34 embodiment is that the vapor conducting portions (the evaporation channels 22 and vapor supply path 11) may be further distanced from, and better thermally separated from, the liquid conducting portions (the condensing channels 12 and liquid return path 21).

Figure 36:
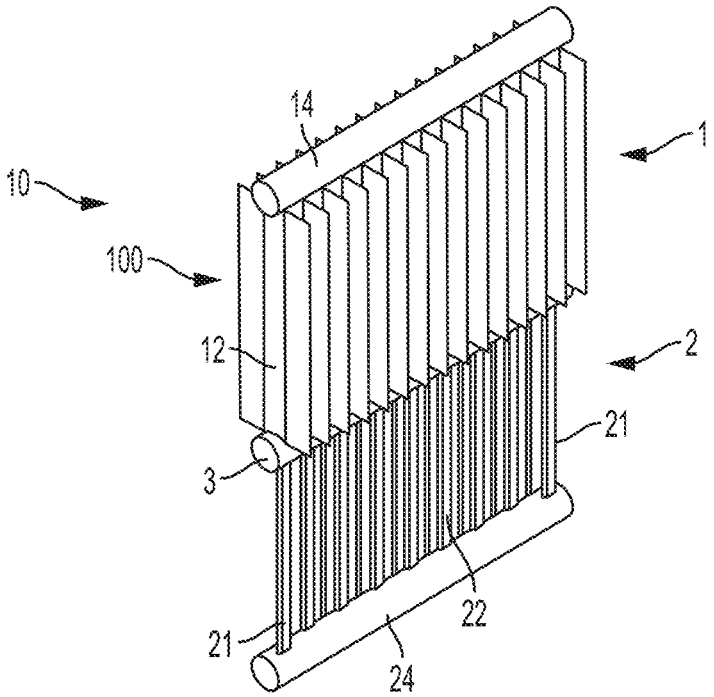
FIG. 36 shows a thermosiphon device including multiport tube structures of the condensing section arranged for counterflow operation.
Figure 37:
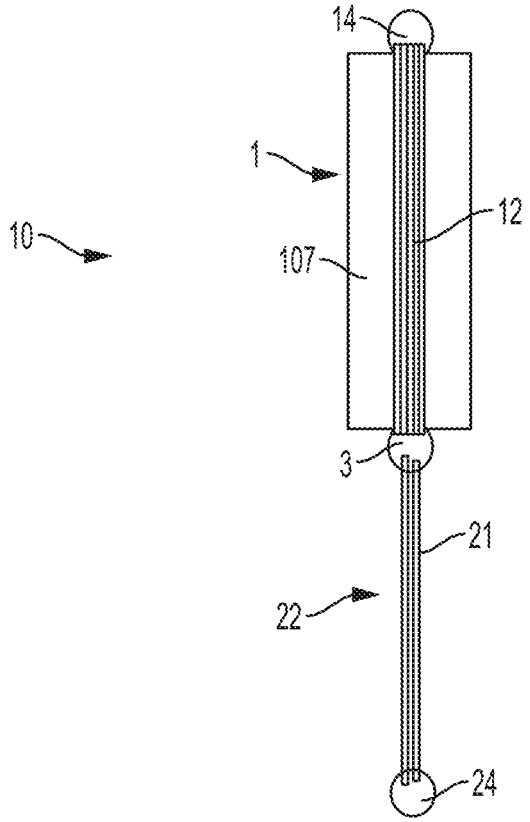
FIG. 37 shows a side view of the device of FIG. 36.

In accordance with another aspect of the invention, a thermosiphon device may have an evaporator section or condenser section that includes a flat multiport tube structure having a section defining a plurality of adjacent flow channels and one or more flat webs that extend away from the flow channels in a plane of the multiport tube structure. For example, FIGS. 36 and 37 show a thermosiphon device 10 that has a plurality of multiport tube structures 100 that form the condenser section 1 and a plurality of multiport tube structures 100 that define evaporation channels 22 for the evaporator section 2. The multiport tube structures 100 may have an arrangement like that shown in FIG. 38 in which a first section 101 includes one or more flow channels, e.g., to define condensing channels or evaporation channels, and one or more flat webs 107 that extend outwardly from the flow channels in a plane of the multiport tube structure 100. The webs 107 may function as thermal transfer structure, e.g., to transfer heat with respect to working fluid in the flow channels. The multiport tube structures 100 of the condenser section 1 may each have a manifold end fluidly coupled with a manifold 3, e.g., to receive working fluid vapor and deliver condensed working fluid liquid. An upper end of the multiport tube structures 100 may be fluidly coupled to a turnaround 14, such as a tubular manifold. The multiport tube structures 100 of the evaporator section 2 in this embodiment are rotated 90 degrees about a vertical axis relative to the multiport tube structures 100 of the condenser section 1 and also have a manifold end fluidly coupled to the manifold 3, e.g., to deliver working fluid vapor to the manifold 3. The webs 107 of the multiport tube structures 100 of the evaporator section 2, along with a surface of the first section 101, may provide a surface to which heat generating components such as electronic devices, can be mounted so that heat can be transferred to the webs 107, and thus to the working fluid in the evaporation channels 22. In this embodiment, a pair of liquid return path conduits 21 fluidly couple the manifold 3 and a turnaround 24 (e.g., a tubular manifold) so that condensed working fluid is delivered to the turnaround 24 and thus to the evaporation channels 22. The liquid return path conduits 21 may be arranged as a multiport tube structure 100 as well, or may be single lumen conduit with no web. In this embodiment, the condensing channels 12 operate as a counterflow device in which vapor travels upwardly through the condensing channels 12 while condensed liquid travels downwardly in the condensing channels 12. However, a dedicated vapor supply path could be provided, if desired, e.g., in a way similar to embodiments described above or otherwise.

Figure 39:
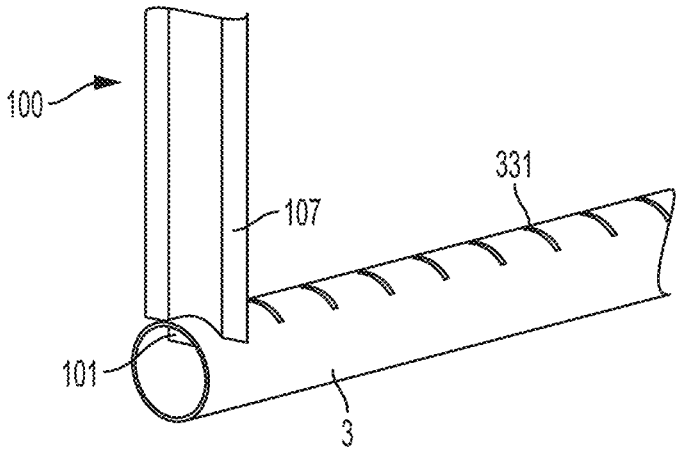
FIG. 39 shows the manifold and a multiport tube structure of the FIG. 36 embodiment.

One advantage to using a multiport tube structure 100 for the evaporator and/or condenser sections 2, 1 is that the web(s) 107 may be used to define an insertion depth of the multiport tube structure 100 with respect to a manifold. For example, FIG. 39 shows the manifold 3 of the FIG. 36 embodiment with a plurality of openings 331 to receive the first section 101 of a respective multiport tube structure 100. While the first section 101 is received into the opening 331, one or more webs 107 of the multiport tube structure 100 may contact the outer wall 34 of the manifold 3 and function as a stop to define the insertion depth of the first section 101 into the manifold 3. This function can be particularly useful when assembling a thermosiphon device 10 and ensuring that certain portions of the device 10, such as a set of evaporation channels 22, are inserted further into a manifold 3 than other portions of the device 10, such as a liquid return path 21. This relative relationship of the evaporation channels 22 and liquid return path 21 can be seen in FIG. 37 and helps ensure that liquid flows downwardly into the liquid return path 21 rather than the evaporation channels 22. As a result, assembly of the device 10 can be simplified since the multiport tube structures 100 may be inserted into a manifold until a stop is contacted and then secured in position.

Figure 38:
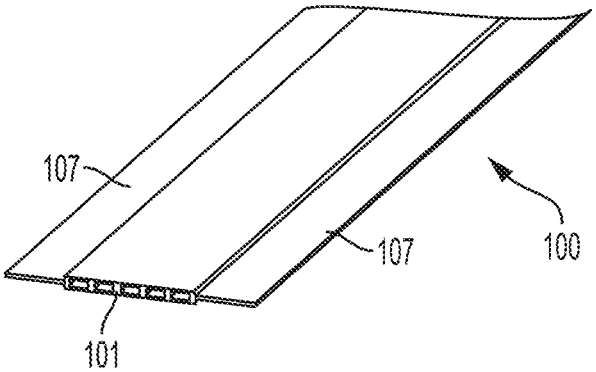
FIG. 38 shows a multiport tube structure for use in the FIG. 36 embodiment.
Figure 40:
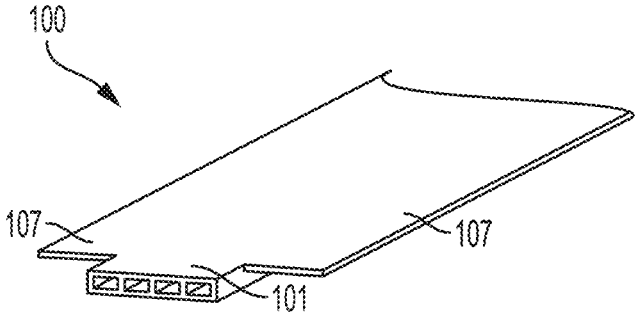
FIG. 40 shows a multiport tube structure having lateral webs flush with a surface of the channel section.
Figure 41:
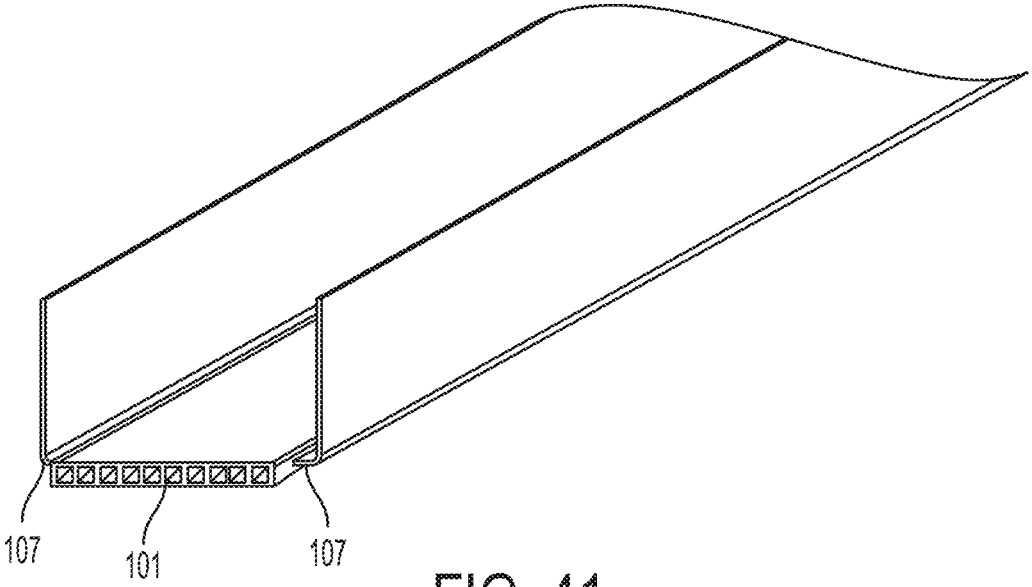
FIG. 41 shows a multiport tube structure having lateral webs with a bent portion.
Figure 42:
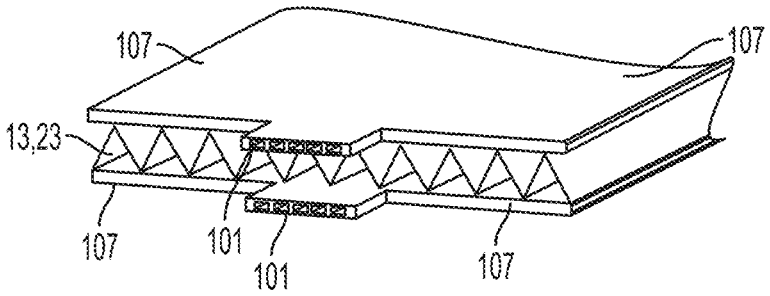
FIG. 42 shows a multiport tube structures having thermal transfer structure arranged between the structures.
Figure 43:
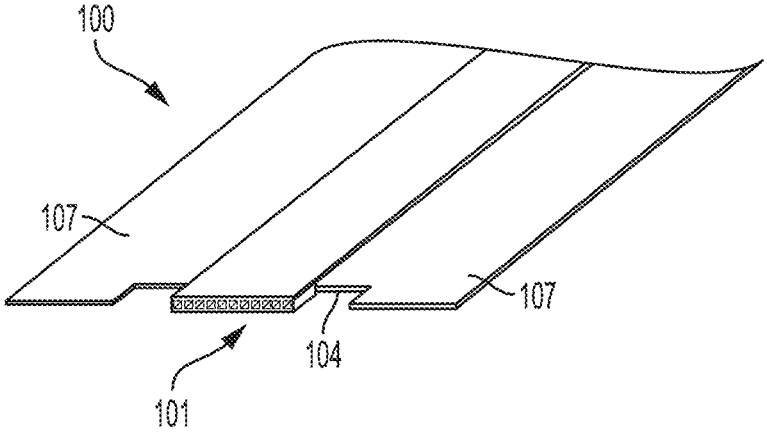
FIG. 43 shows a multiport tube structure having gaps in the webs at an end of the structure.

While FIG. 38 shows one illustrative embodiment for a multiport tube structure 100 and outer web arrangement, other arrangements are possible. For example, FIG. 40 shows another configuration in which a pair of webs 107 are positioned so as to be flush with one side surface of the first section 101. Such a configuration may be useful, for example, when attaching a heat generating component, heat plate or other structure to the multiport tube structure 100. Other arrangements are possible too, including a multiport tube structure 100 with webs 107 extending from both side surfaces of the first section 101, etc. FIG. 41 shows another arrangement in which webs 107 have portions that extend outwardly from the first section 101 in the plane of the first section 101, and have upwardly extending portions arranged perpendicular to the plane of the multiport tube structure 100. Such an arrangement may increase the surface area of the webs 107 while reducing the overall width of the multiport tube structure 100, and could be used for the evaporation channels 22 in the FIG. 36 embodiment. FIG. 42 shows yet another arrangement for a multiport tube structure 100 in which the webs 107 have a thickness equal to the first section 101. Thus, the webs 107 are flush with both side surfaces of the first section 101. One possibility for such an arrangement is to provide thermal transfer structure 13, 23, such as one or more fins, that are thermally coupled to the webs 107 and first sections 101 of adjacent multiport tube structures 100. FIG. 43 shows yet another arrangement in which webs 107 define a gap 104 near an end of the first section 101. As can be appreciated in FIG. 44, the gaps 104 may help define an insertion distance for the first section 101 into a manifold 3 while the additional surface area of the webs 107 may aid in heat transfer.

Figure 44:
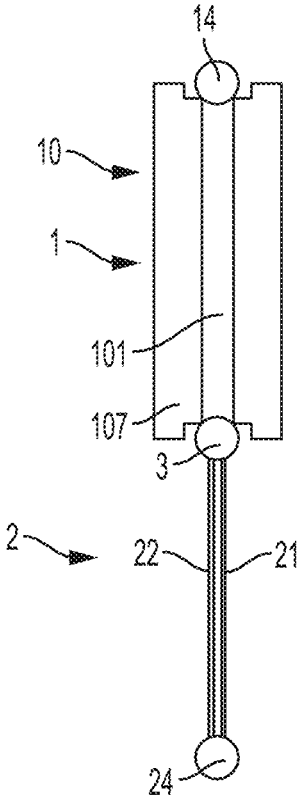
FIG. 44 shows a thermosiphon device in which a multiport tube structure shown in FIG. 43.
Figure 45:
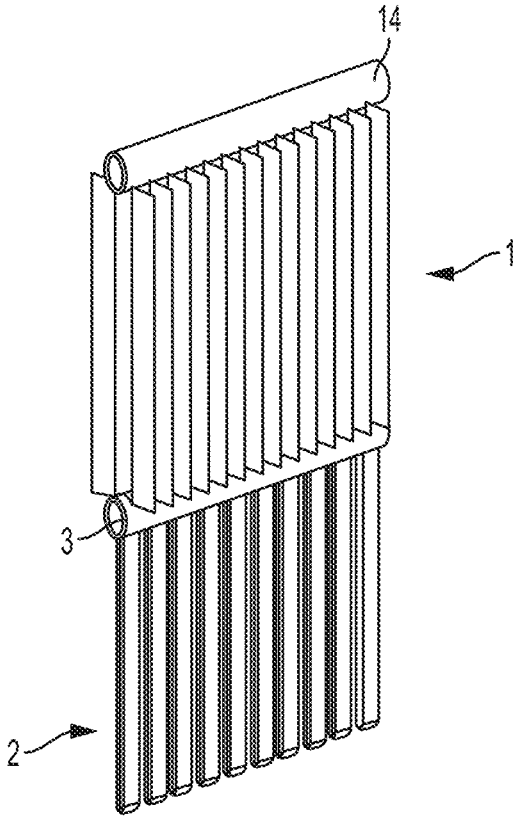
FIG. 45 shows a thermosiphon device similar to that of FIG. 45 but omitting a lower turnaround.
Figure 46:
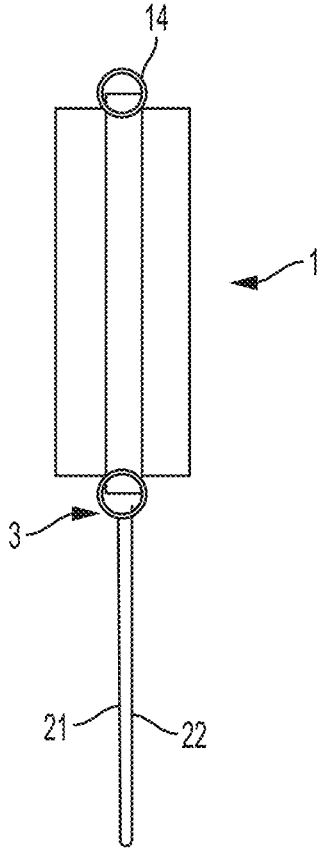
FIG. 46 shows a side view of the device of FIG. 45.

While the arrangement in FIG. 44 shows the liquid return path 21 and evaporation channels 22 in communication with a turnaround 24, other arrangements are possible such as that shown in FIGS. 45 and 46. In this embodiment, the liquid return path 21 and evaporation channels 22 are formed from bent multiport tube structures 100 so as to obviate the need for a turnaround manifold 24. That is, the multiport tube structures 100 include a bend where the lower end of the liquid return path 21 communicates with the evaporation channels 22. In some cases, any web 107 may be removed from the liquid return path section of the multiport tube structure 100, e.g., to reduce heat transfer. Note in FIG. 46 that the multiport tube structure 100 is bent so that the evaporator channel section extends further into the manifold 3 than the liquid return path section. This helps ensure liquid flows into the liquid return path and not the evaporation channels.

Figure 47:
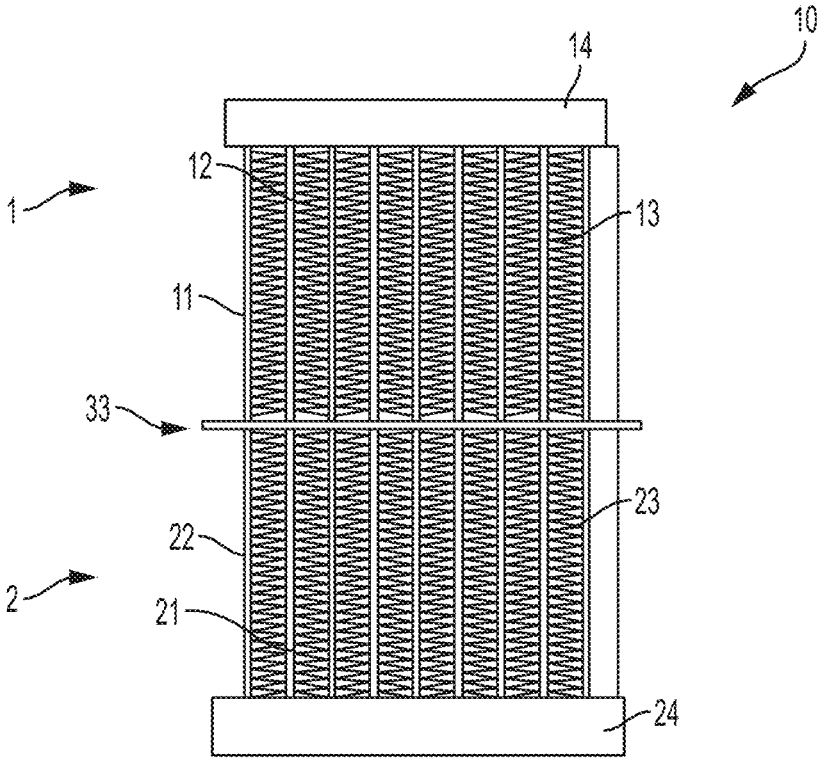
FIG. 47 shows a thermosiphon device in which multiport tube structures define portions of both the evaporator and condenser sections.

FIG. 47 shows another illustrative embodiment of a thermosiphon device 10 that employs one or more flat multiport tube structures having a section with a plurality of adjacent flow channels and one or more flat webs that extend away from the flow channels in a plane of the multiport tube structure. In this illustrative embodiment, each flat multiport tube structure 100 defines a set of evaporation channels 22 and a vapor supply path 11, or a set of condensing channels 12 and a liquid return path 21. That is, each multiport tube structure 100 defines a portion of a condenser section 1 and an evaporator section 2. Opposite ends of the multiport tube structures 100 are fluidly coupled to turnarounds 14 and 24, so that vapor flowing upwardly in the vapor supply path 11 of one or more multiport tube structures 100 can enter the turnaround 14 and into the condensing channels 12 of one or more multiport tube structures 100, and so that liquid flowing downwardly in a liquid return path 21 can enter the turnaround 24 and into evaporation channels 22 of one or more multiport tube structures 100. The multiport tube structures 100 may have a cross section like that in FIG. 38, 40, 42, 43, or others. A flange 33 may provide a separation between the condenser and evaporator sections 1, 2, e.g., so that warm air at the evaporator sections 2 is kept away from the condenser sections 1. Thermal transfer structure 13 may be thermally coupled to portions of the multiport tube structures 100 that define condensing channels 12, and thermal transfer structure 23 may be thermally coupled to portions of the multiport tube structures 100 that define evaporation channels 22. However, portions of the multiport tube structures 100 that define a liquid return path or vapor supply path may be free of thermal transfer structure, and in some embodiments portions of a web 107 may be removed from these portions as well to reduce heat transfer. While in this embodiment multiport tube structures 100 that define evaporation channels 22/vapor supply path 11 are interdigitated with multiport tube structures 100 that define condensing channels 12/liquid return path 21, other arrangements are possible, such as clustering multiport tube structures 100 that define evaporation channels 22/vapor supply path 11, or that define condensing channels 12/liquid return path 21 in groups of two or more.

Figure 48:
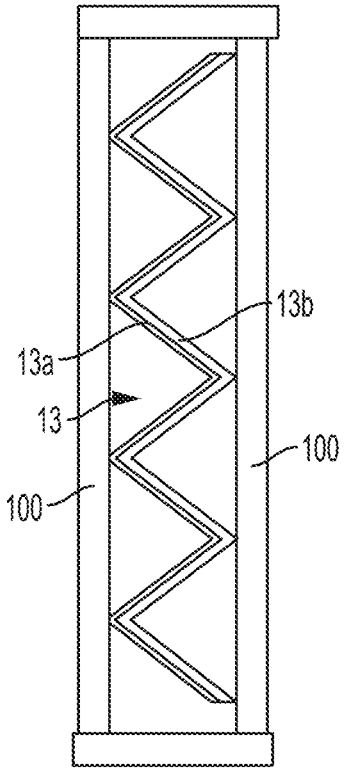
FIG. 48 shows a thermal transfer structure arrangement for use in the FIG. 47 device.

FIG. 48 shows one technique for arranging thermal transfer structure 13, 23 like that shown in FIG. 47. Thermal transfer structure 13 (or 23) may be sandwiched between two adjacent multiport tube structures 100, e.g., squeezed in physical contact between webs 107 or other portions of the multiport tube structures 100. The thermal transfer structure 13 may include a cladded side 13*a* and a non-cladded side 13*b* so that during a brazing, soldering or other similar process, the cladded side 13*a* is bonded to the adjacent multiport tube structure 100 but the non-cladded side 13*b* is not bonded to the adjacent multiport tube structure 100. As a result, the thermal transfer structure 13 may better transfer heat with the multiport tube structure 100 on the cladded side 13*a* than on the non-cladded side 13*b*.

Figure 49:
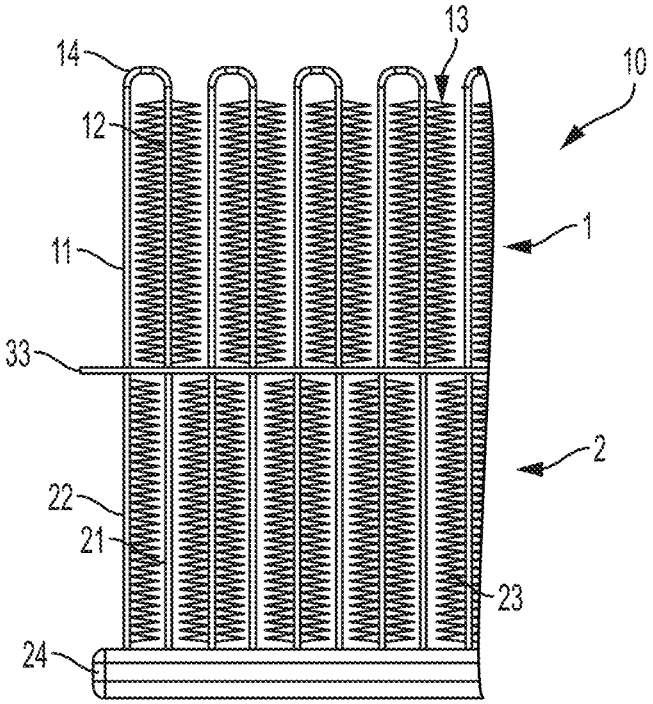
FIG. 49 shows a modified version of the FIG. 47 device in which an upper turnaround manifold is replaced with bent tube sections.
Figure 50:
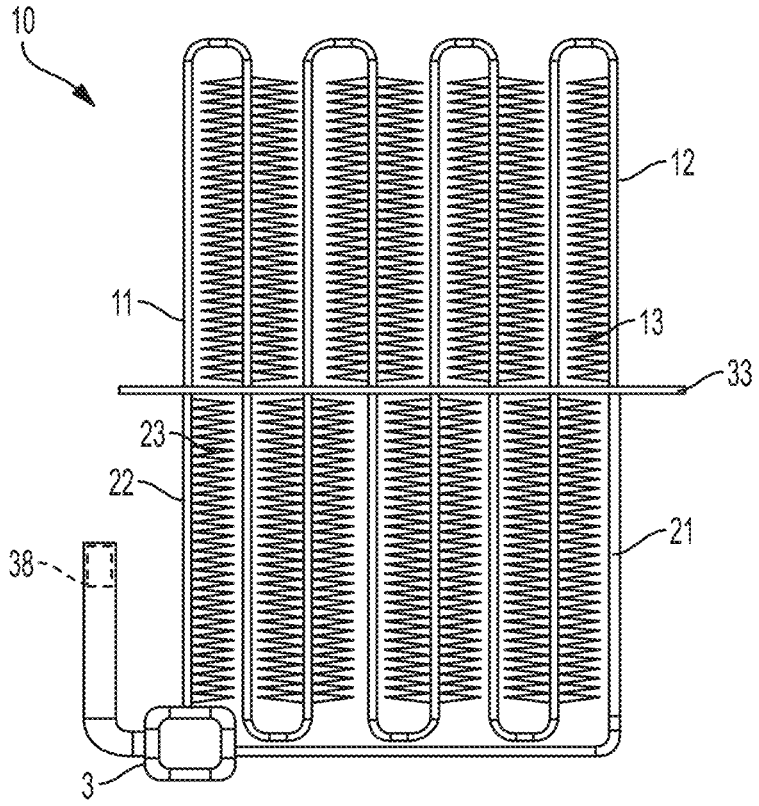
FIG. 50 shows a modified version of the FIG. 49 device in which a lower turnaround manifold is replaced with bent tube sections.

FIG. 49 shows another thermosiphon device 10 that is arranged similarly to that in FIG. 47, but the upper turnaround 14 is omitted. In its place, the multiport tube structures 100 are bent to provide a turnaround 14 that fluidly connects a vapor supply path section 11 of each multiport tube structure 100 with a condensing channel 21 section of the structure 100. FIG. 50 shows yet another embodiment similar to the FIG. 49 embodiment but with the lower turnaround 24 removed. Instead, the multiport tube structures 100 are bent to provide turnarounds 24 for each section that defines a liquid return path and a section that defines a set of evaporation channels. Since flow in this arrangement will follow a closed loop, a manifold 3 is provided so that liquid returned in the final liquid return path 21 at the extreme right in FIG. 49 can return to the manifold 3 and enter the evaporation channels 22 of the multiport tube structure 100 at the extreme left in FIG. 49. A fill tube 38 is provided to allow the device 10 to be filled with working fluid in liquid form prior to being put into service.

Figure 51:
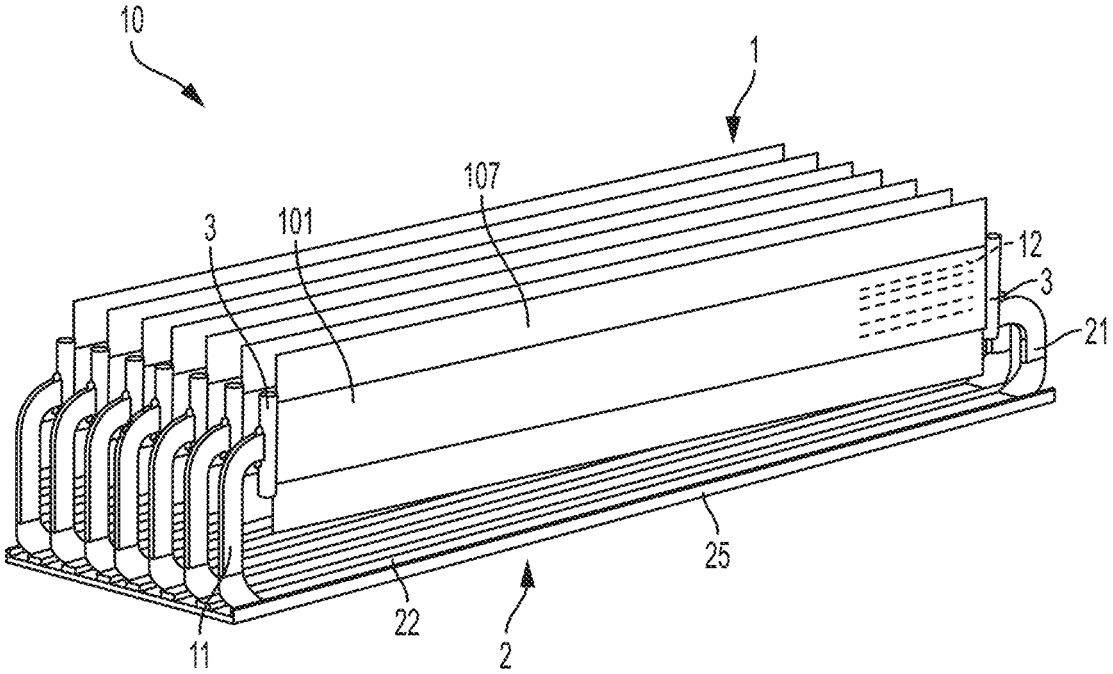
FIG. 51 shows a thermosiphon device in which multiport tube structures define a condenser section.
Figure 52:
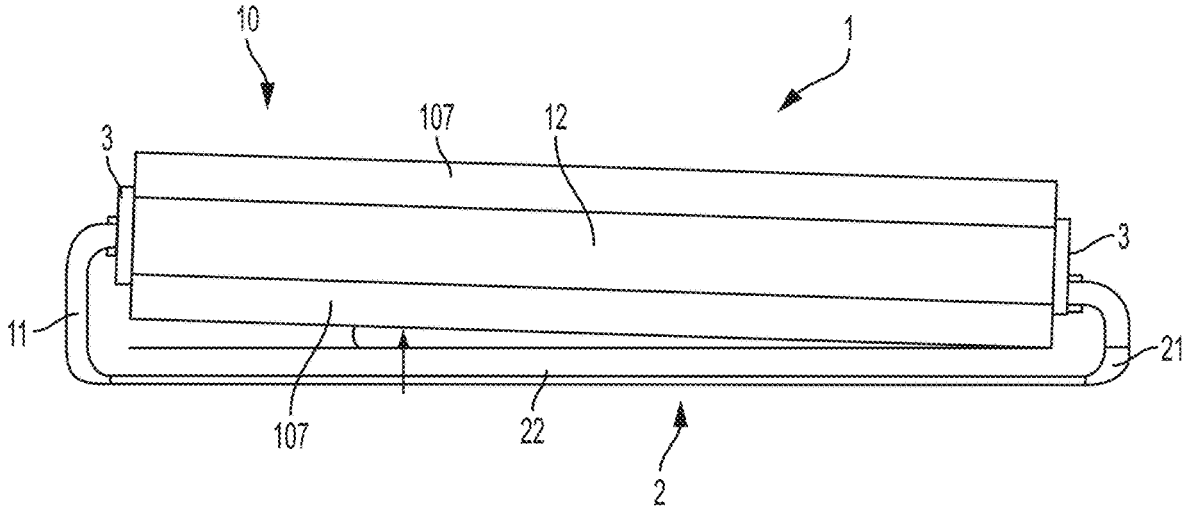
FIG. 52 shows a side view of the FIG. 51 embodiment.
Figure 53:
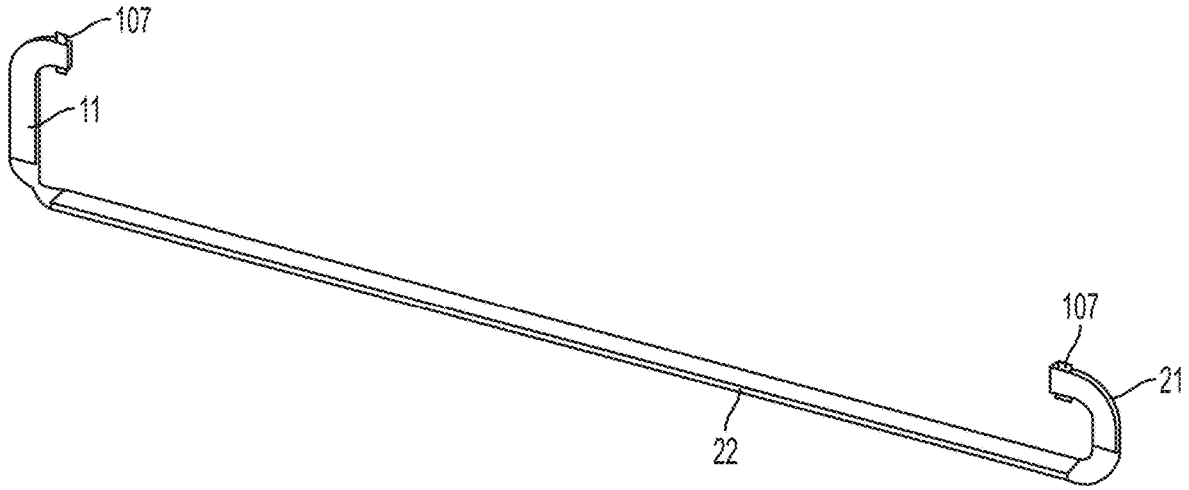
FIG. 53 shows the evaporator section and vapor supply path of the FIG. 51 device.
Figure 54:
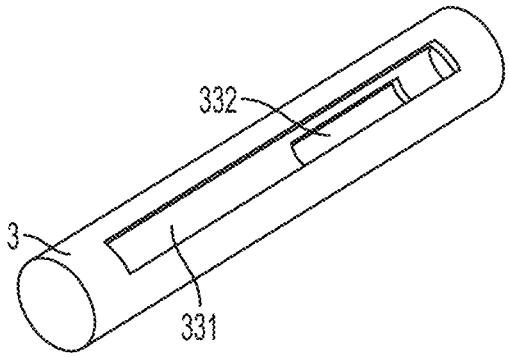
FIG. 54 shows a manifold of the FIG. 51 device.
Figure 55:
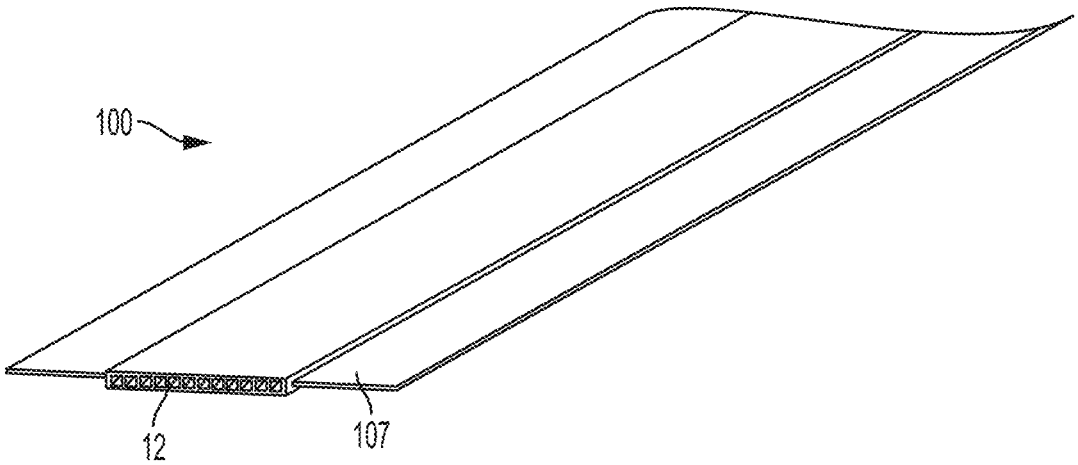
FIG. 55 shows a multiport tube structure including the condenser channels of the FIG. 51 device.
Figure 56:
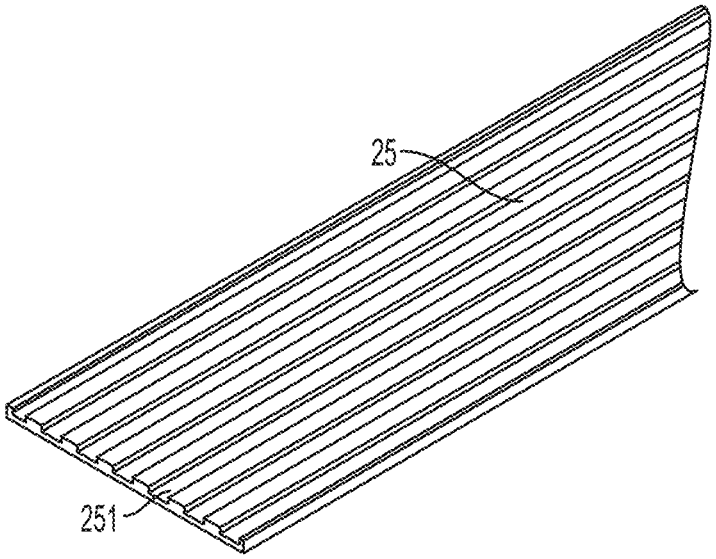
FIG. 56 shows a base plate for the FIG. 51 device.

FIG. 51 shows another embodiment of a thermosiphon device 10 that includes a multiport tube structure 100 in an evaporator or condenser section. In this embodiment, the condenser section 1 includes a plurality of multiport tube structures 100 that each defines a set of condensing channels 12 and includes webs 107 extending upwardly and downwardly in the plane of the multiport tube structure 100. The condensing channels 12 are provided with working fluid vapor by a vapor supply path 11 that leads from a set of evaporation channels 22 of the evaporation section 2. As can be seen in FIG. 52, since one end of the condensing channels 12 is positioned higher than the opposite end, condensed working fluid flows into a liquid return path 21 and then to the evaporation channels 22. All of the liquid return path 21, the evaporation channels 22 and the vapor supply path 11 may be formed from a multiport tube structure 100 which may or may not have a web 107. As shown in FIG. 53, sections of web 107 may be provided for the vapor supply path 11 and the liquid return path 21 so as to define an insertion depth of the tube ends into a respective manifold 3. As can be seen in FIG. 51, manifolds 3 may be employed to fluidly couple the vapor supply path 11 and the liquid return path 21 to the condensing channels 12. FIG. 54 shows a manifold 3 which may include an opening 331 to couple with the section of the multiport tube structure 100 defining condensing channels 12 and an opening 332 to couple with the vapor supply path 11 or the liquid return path 21. The manifolds 3 are needed in this embodiment because the multiport tube structures 100 that define the condensing channels 12 may have a size and/or number of flow channels that is different from the size and/or number of flow channels in the multiport tube structure 100 that defines the liquid return path 21, the evaporation channels 22 and the vapor supply path 11. FIG. 55 shows an end view of a multiport tube structure 100 having a section that defines a plurality of flow channels for the condensing channels 12 and webs 107 extending outwardly from the section in the plane of the multiport tube structure 100. Of course, other numbers of flow channels may be employed. FIG. 56 shows a base plate 25 that may be used with the thermosiphon device 10. In this embodiment, the base plate 25 includes a plurality of grooves 251 that may each receive a set of evaporation channels 22, e.g., which may be welded or otherwise bonded in place to thermally couple the channels 22 with the base plate 25. The base plate 25 may itself be coupled with a heat source, such as one or more heat generating devices and transfer heat to the evaporation channels 22.

Figure 57:
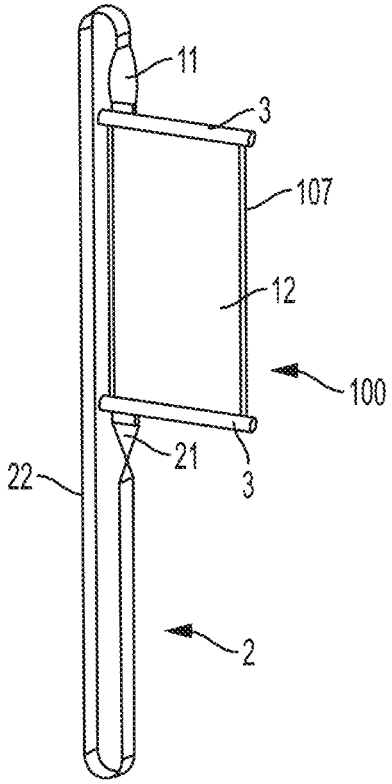
FIG. 57 shows a thermosiphon device similar to the FIG. 51 device but oriented in a vertical direction.
Figure 58:
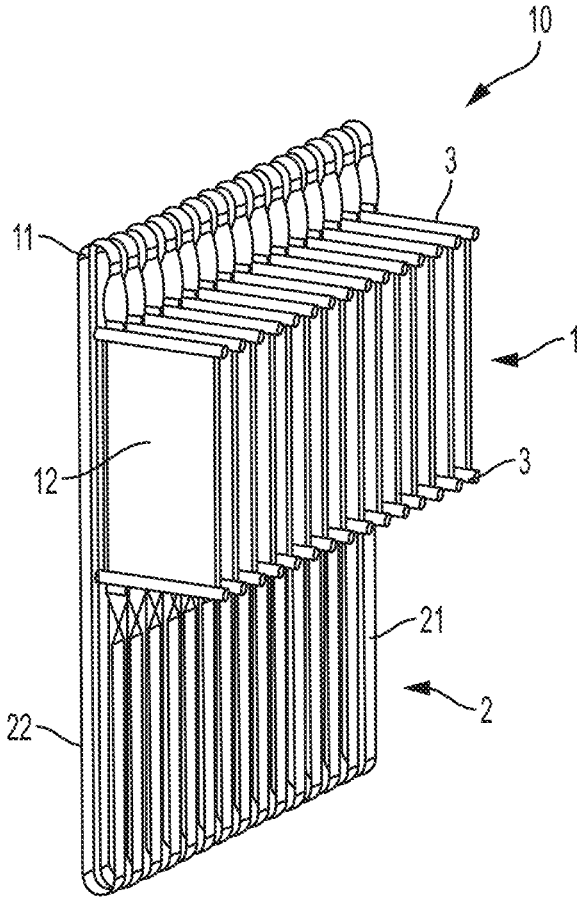
FIG. 58 shows a thermosiphon device having multiple devices like that shown in FIG. 57.
Figure 59:
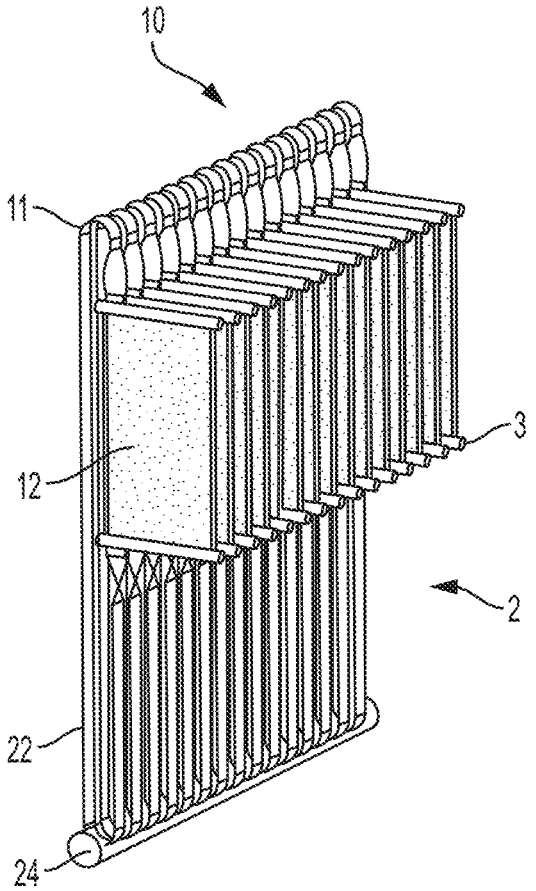
FIG. 59 shows a thermosiphon device similar to the FIG. 58 device and having a turnaround for the evaporator section.
Figure 59A:
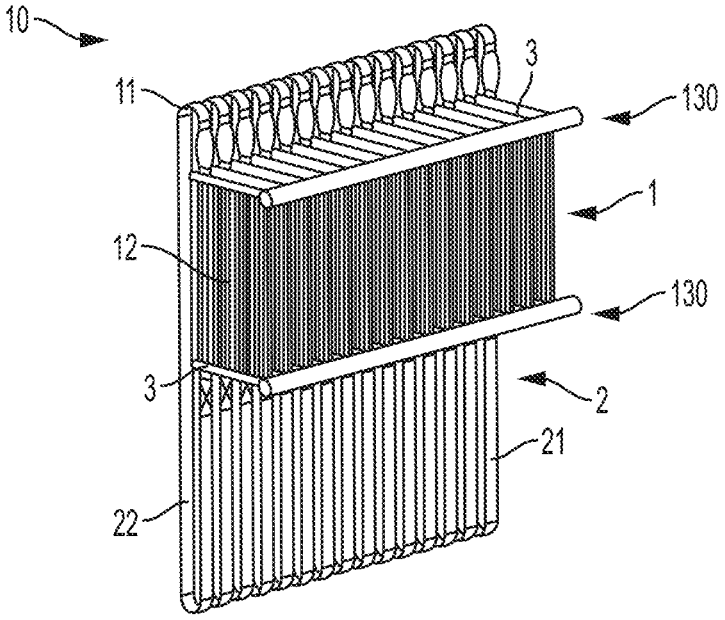
FIG. 59A shows a thermosiphon device similar to the FIG. 59 device and has condenser section manifolds coupled in fluid communication.

FIG. 57 shows an illustrative embodiment of a thermosiphon device 10 similar to that in FIG. 51, except that the device 10 is shown oriented in a more vertical direction than the FIG. 51 embodiment. Similar to the FIG. 51 embodiment, the FIG. 57 embodiment includes a multiport tube structure 100 that defines a plurality of condensing channels 12 and which may have a cross section like that in FIG. 38, 40, 42, 43, or others. Like the FIG. 51 embodiment, all of the liquid return path 21, the evaporation channels 22 and the vapor supply path 11 may be formed from a multiport tube structure 100 which may or may not have a web 107. As shown in FIG. 58, multiple ones of the thermosiphon devices 10 in FIG. 57 may be ganged together into a single thermosiphon device 10, and as can be seen in FIG. 59, the liquid return paths 21 and evaporation channels 22 may be coupled to a common turnaround 24, which may be a tubular manifold. Alternately, or in addition, the manifolds 3 that couple the condensing channels 12 to the vapor supply path 11 and/or the liquid return path 21 may be coupled together by a common manifold 130 as seen in FIG. 59A. Such an arrangement may help balance liquid and vapor flow amongst the parallel units.

Figure 60:
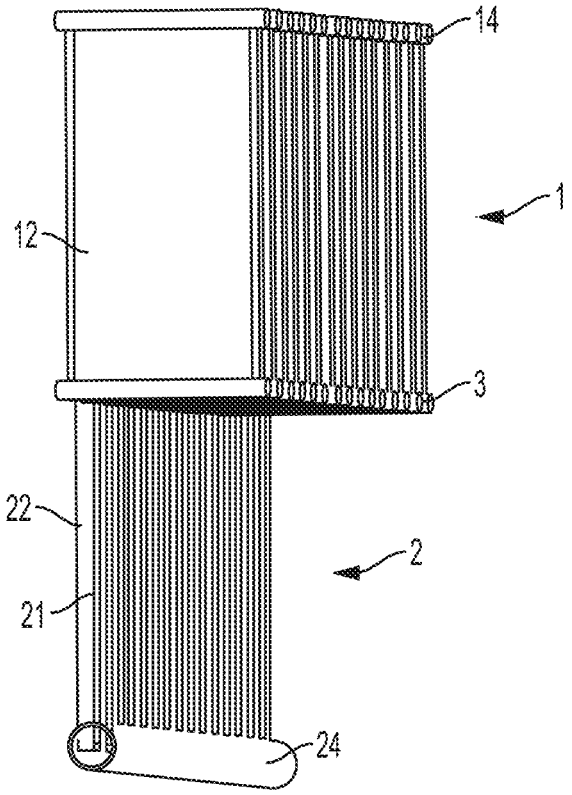
FIG. 60 shows a thermosiphon device including counterflow condenser channels and an evaporator section including a turnaround.

FIG. 60 shows another illustrative embodiment of a thermosiphon device 10 that includes a condenser section 1 that operates in a counterflow-type operation (like that in the device 10 of FIG. 36). However, somewhat differently from FIG. 36, the condenser channels 12 of each flat multiport tube structure 100 are fluidly coupled by a manifold 3 at a bottom end and a turnaround 14 at a top end. The multiport tube structures 100 may or may not have a web 107. Also in this embodiment, the evaporator section includes evaporator channels 22 and liquid supply paths 21 that are provided by a plurality of multiport tube structures 100 that may have a cross section like that in FIG. 31. Thus, sections of the multiport tube structures 100 that define the evaporation channels 22 may be joined to sections that define the liquid return path 21 by a web 103. Outer webs 107 and other features may be provided or not.

Figure 61:
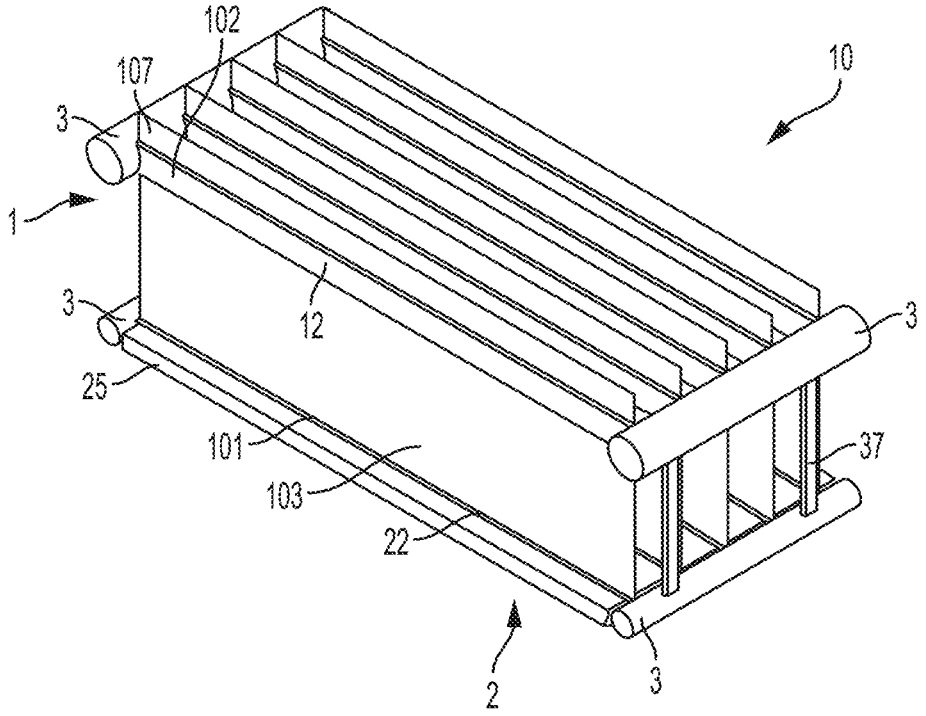
FIG. 61 shows a thermosiphon device in which multiport tube structures include condensing and evaporation channels.

In another aspect of the invention, a thermosiphon device may include at least one multiport tube structure that defines at least one evaporation channel and at least one condensing channel. The at least one condensing channel may be joined to the at least one evaporation channel by a web that extends between the at least one condensing channel and the at least one evaporation channel in a plane of the multiport tube structure. For example, FIG. 61 shows a thermosiphon device 10 that includes a plurality of multiport tube structures 100 that each includes a plurality of evaporation channels 22 (defined by a first section 101) and a plurality of condensing channels 12 (defined by a second section 102) joined by a web 103. An outer web 107 is also provided in this embodiment that extends outwardly from the second section 102 in a plane of the multiport tube structure 100. Ends of the first and second sections 101, 102 are fluidly coupled to a respective manifold 3. In this embodiment, five multiport tube structures 100 are shown, but more or fewer multiport tube structures 100 could be used. Upper and lower manifolds 3 on opposite sides of the device 10 are fluidly coupled by conduits 37, which may be formed as a multiport tube structure 100, e.g., having a cross section like that in FIG. 38. As described above, the use of a multiport tube structure 100 for a conduit 37 may help define an insertion depth into the manifolds 3 easier. The first section 101 of each multiport tube structure 100 may be thermally coupled to a base plate 25, e.g., so as to receive heat from the base plate 25. As will be understood, working fluid liquid that is evaporated in the evaporation channel 22 may flow to a lower manifold 3, then flow upwardly through a conduit 37, into an upper manifold 3 and into a condensing channel 21. Condensed working fluid liquid may flow in an opposite direction. The device 10 may be relatively tolerant of tilting or rotation in different directions, i.e., the device 10 may continue to operate properly even when tilted or rotated to limited degrees about various axes parallel to the plane of the base plate 25. This may make the device 10 suitable for a variety of applications or in applications where the device 10 moves in different directions, such as on an airplane.

Figure 62:
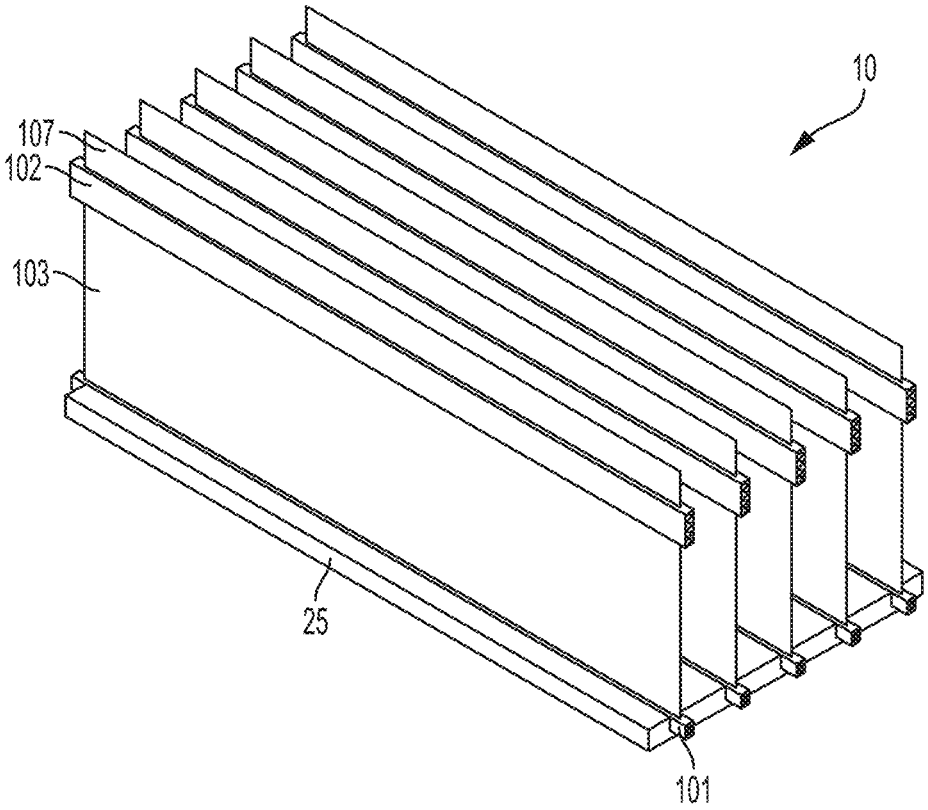
FIG. 62 shows the FIG. 61 device with manifolds removed.
Figure 63:
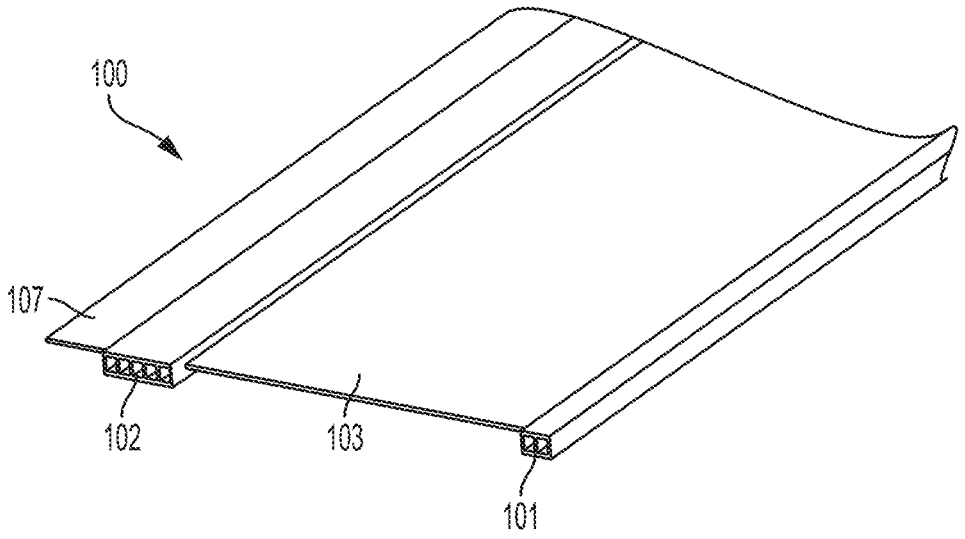
FIG. 63 shows a multiport tube structure for use in the FIG. 61 device.

FIG. 62 shows the device 10 with the manifolds 3 and conduits 37 removed for clarity. As can be seen in FIG. 62 and in FIG. 63, the multiport tube structures 100 may have a cross section in which the web 103 is relatively wide and in which the first section 101 (defining the evaporation channels 22) has fewer flow channels than the second section 102 (defining the condensing channels 12). Of course, other arrangements are possible, including more and few flow channels for either section 101, 102, a web 103 with different dimensions (width, thickness, length) or material, a web 103 with gaps or removed sections, etc. Also, the web 103 and/or web 107 may help define an insertion depth for the first and second sections 101, 102 into a respective manifold 3, as discussed above.

Figure 64:
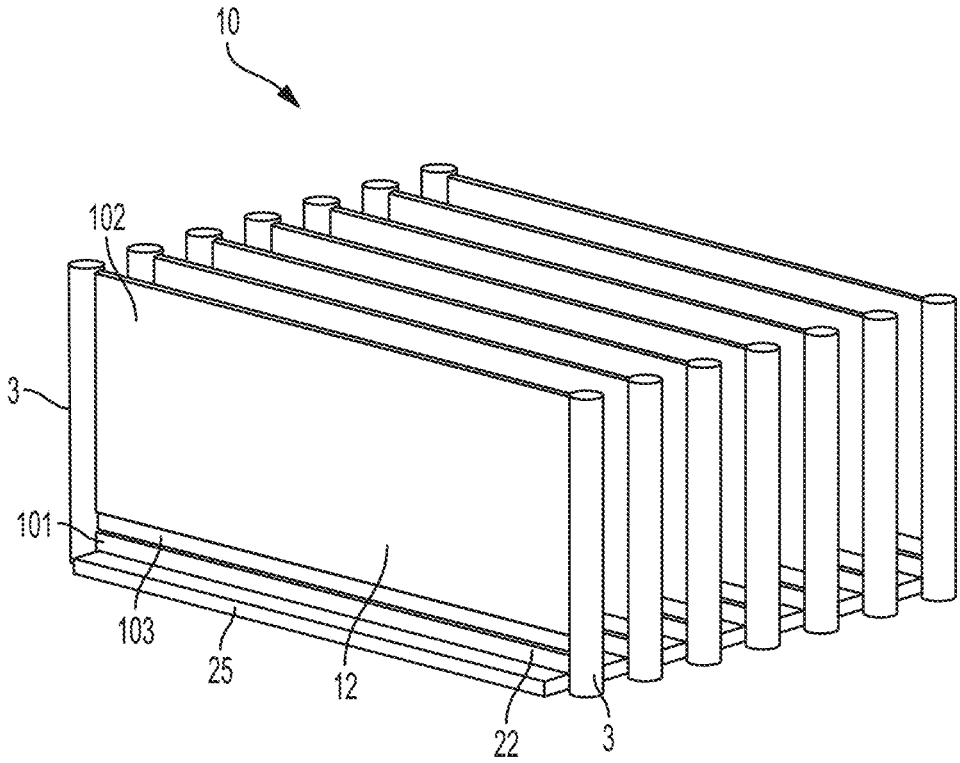
FIG. 64 shows a thermosiphon device similar to the device of FIG. 61 and having only evaporator and condenser channel of each multiport tube structure fluidly connected.
Figure 65:
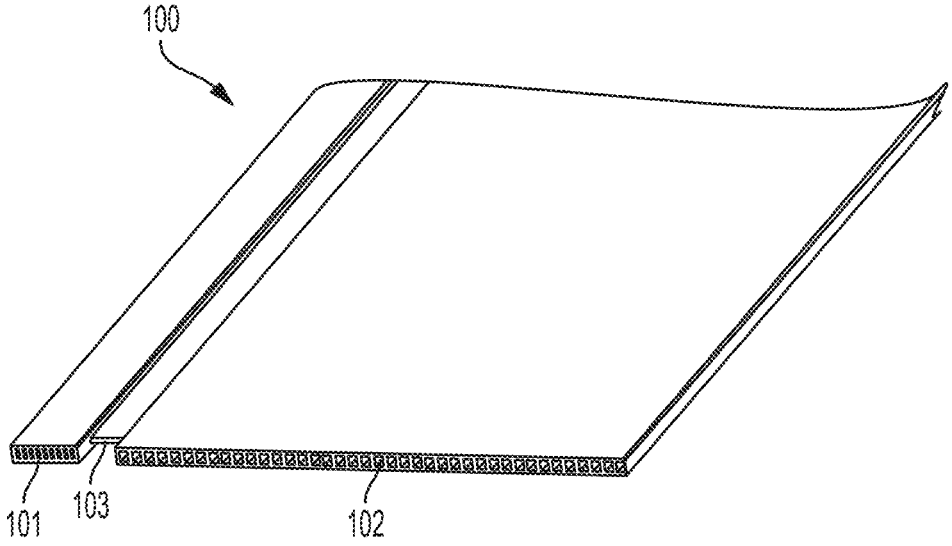
FIG. 65 shows a multiport tube structure for use in the FIG. 64 device.
Figure 66:
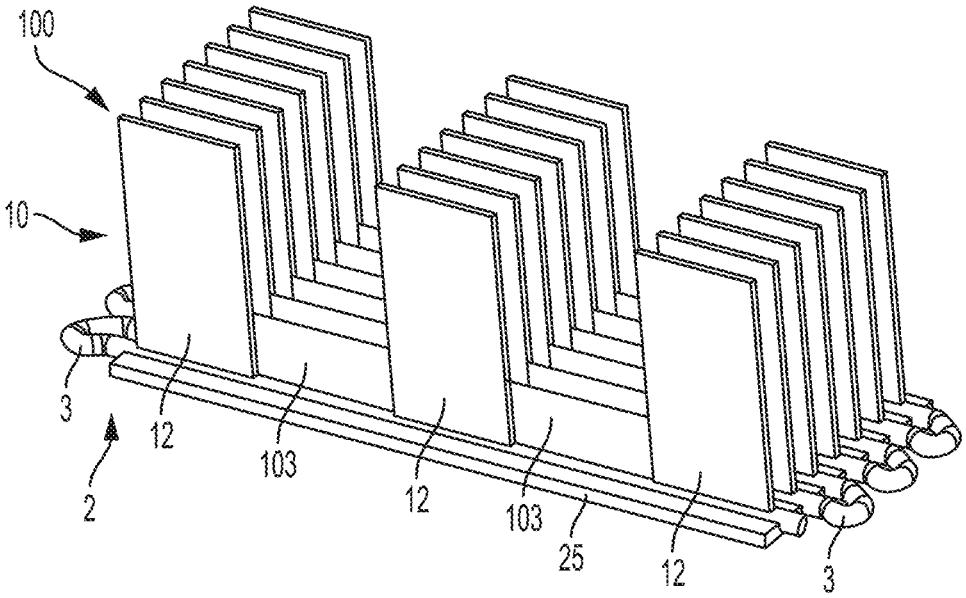
FIG. 66 shows a thermosiphon device including counterflow condenser channels arranged in a multiport tube structure.

FIG. 64 shows another embodiment of a thermosiphon device 10 that is similar to that in FIG. 61 except that the first and second sections 101, 102 of each multiport tube structure 100 are fluidly coupled by a pair of manifolds 3 and the multiport tube structures 100 are not fluidly coupled together. Another difference is that the cross section of the multiport tube structures 100 is different, as can be seen in FIG. 65. In this example, the web 103 is relatively narrow, and both the first and second sections 101, 102 (defining the evaporation channels 22 and condensing channels 12, respectively) have more flow channels. The manifolds 3 may have slot-like openings to respectively receive the first and second sections 101, 102, and the web 103 may define an insertion depth for both sections 101, 102 in to the manifold. In contrast to the FIG. 61 embodiment, the FIG. 64 embodiment may be more tolerant of rotation of the device about axes that extend along a length of the multiport tube structures 100. This is because working fluid cannot flow from one multiport tube structure 100 to another. In accordance with another aspect of the invention, a thermosiphon may include a condenser section with a plurality of sets of condensing channels arranged to operate in a counterflow mode. That is, the condensing channels may receive vaporized working fluid at a bottom end, conduct a flow of vapor upwardly in the channels, transfer heat from evaporated liquid to a surrounding environment to condense the vapor to form a liquid, and conduct the flow of condensed liquid back to the bottom end of the channels. At least two of the plurality of sets of condensing channels may be part of a flat multiport tube structure in which the one set of condensing channels is joined to the another set of condensing channels by a flat web that extends between the sets of condensing channels in a plane of the multiport tube structure. For example, FIG. 66 shows a thermosiphon device 10 that includes a plurality of sets of condensing channels 12 that are fluidly coupled at a bottom end to a manifold 3. The manifold 3 may be thermally coupled to a base plate 25, e.g., to receive heat to vaporize working fluid liquid in the manifold 3. The vapor then enters the condensing channels 12, is condensed, and returns to the manifold 3.

Figure 67:
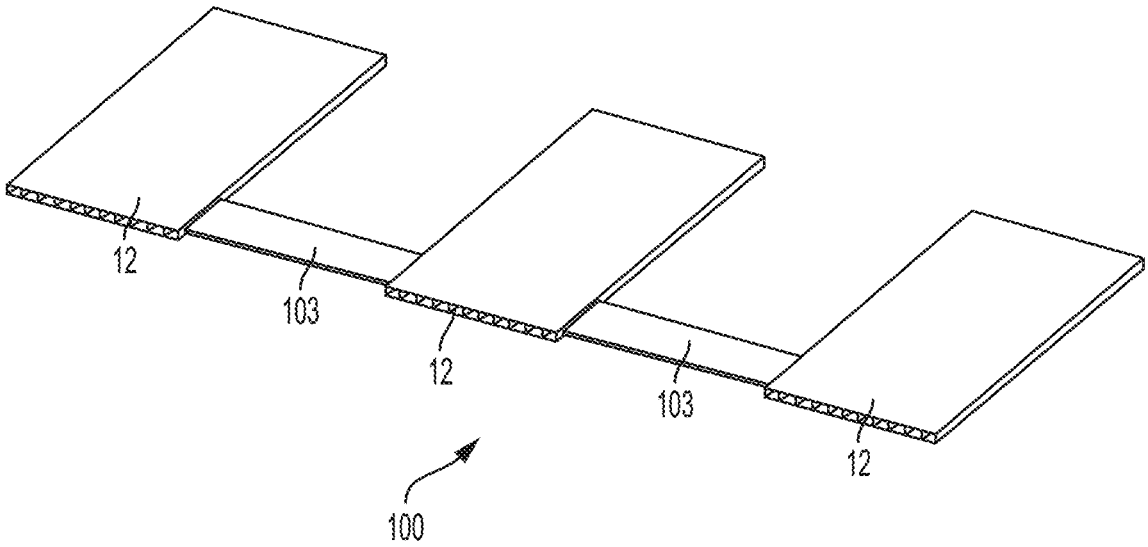
FIG. 67 shows a multiport tube structure for use in the FIG. 66 device.

This embodiment includes multiport tube structures 100 that each have three sets of condensing channels 12 (defined by first, second and third sections each with multiple flow channels), as can be seen in FIG. 67. The sets of condensing channels 12 are joined to an adjacent set by a web 103 that extends in a plane of the multiport tube structure 100. The web 103 can not only aid in heat transfer, but also define an insertion depth of a bottom end of the condensing channels 12 into the manifold 3 and assist in simplifying manufacture of the device 10, e.g., by allowing three condensing channel sets to be mated with the manifold at one time. The upper end of the condensing channels 12 may be closed by crimping, a cap, or other arrangement.

Figure 68:
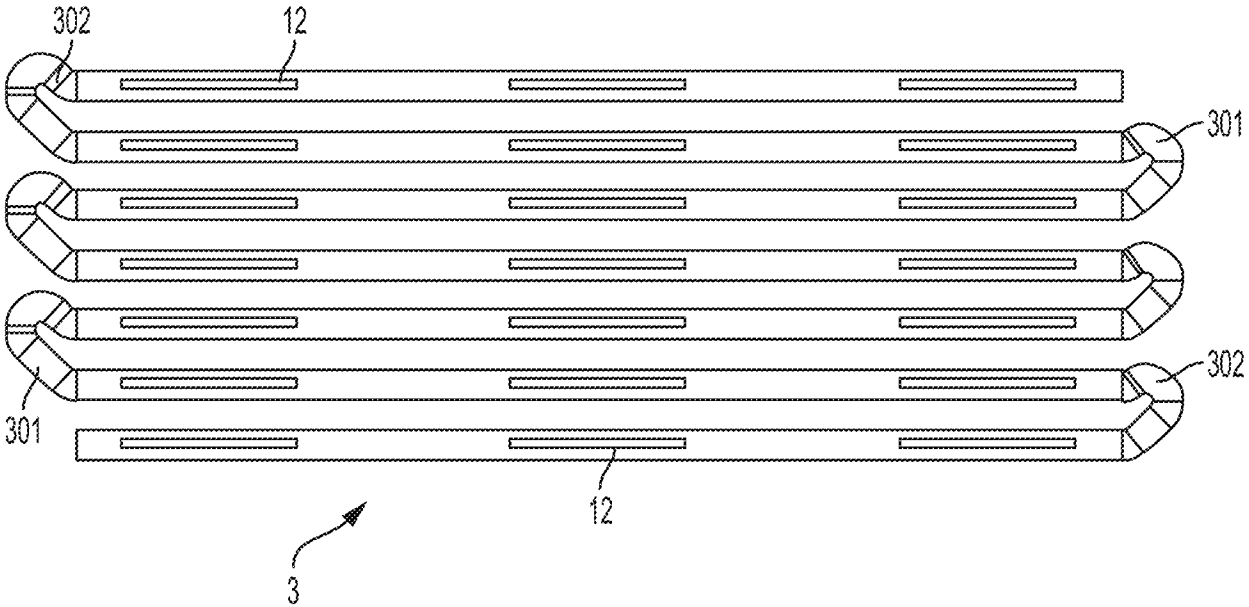
FIG. 68 shows the FIG. 66 device in a vertical orientation.
Figure 69:
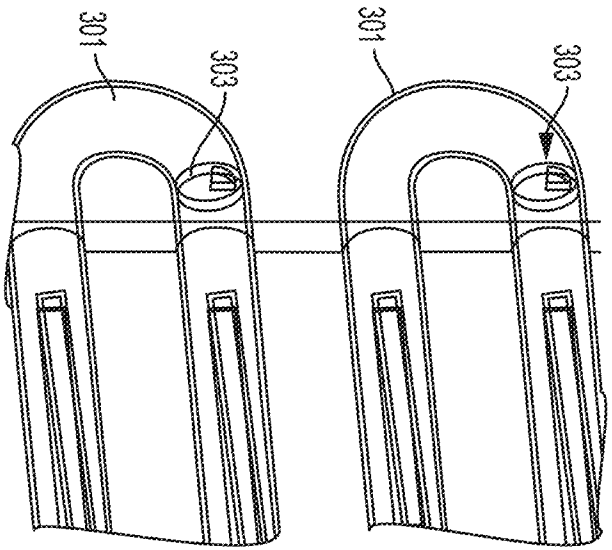
FIG. 69 shows a manifold arrangement including plugs to control liquid flow.

While the embodiment in FIG. 66 is shown operating in a horizontal position, the device 10 may operate in other orientations, including orientations in which the device 10 is rotated about an axis parallel to the length of the multiport tube structures 100. For example, FIG. 68 shows the manifold 3 oriented in a vertical position, e.g., in which the base plate 25 is oriented vertically. The manifold 3 includes bends 301 that are arranged to form a trap 302 that prevents each manifold segment 3 engaged with a multiport tube structure 100 from completely draining of working fluid liquid. As a result, the device 10 can continue to operate properly even when tilted up to 90 degrees relative to the horizontal about an axis parallel to the length of the multiport tube structures 100. While the FIG. 66 embodiment includes bends 301 arranged to form a trap 302, trapping liquid in manifold sections can be achieved in other ways. For example, FIG. 69 shows U-bends 301 in a manifold 3 that have a plug 303 positioned at one end of each bend 301. The plug 303 has an opening at one side so that the plug 303 functions to trap liquid in the manifold section up to the level of the opening in the plug. 303.

Figure 70:
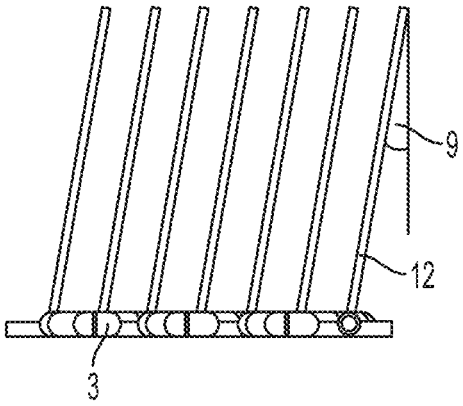
FIG. 70 shows a modified version of the FIG. 66 device with condensing channels arranged at a non-perpendicular angle to a plane of the manifold.
Figure 71:
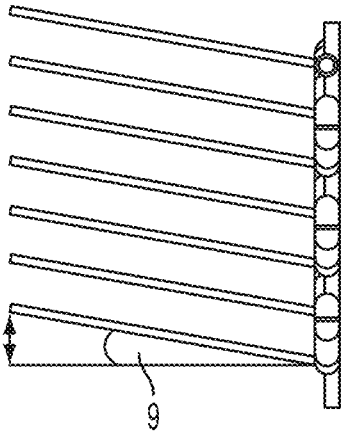
FIG. 71 shows the FIG. 70 device in a vertical orientation.
Figure 72:
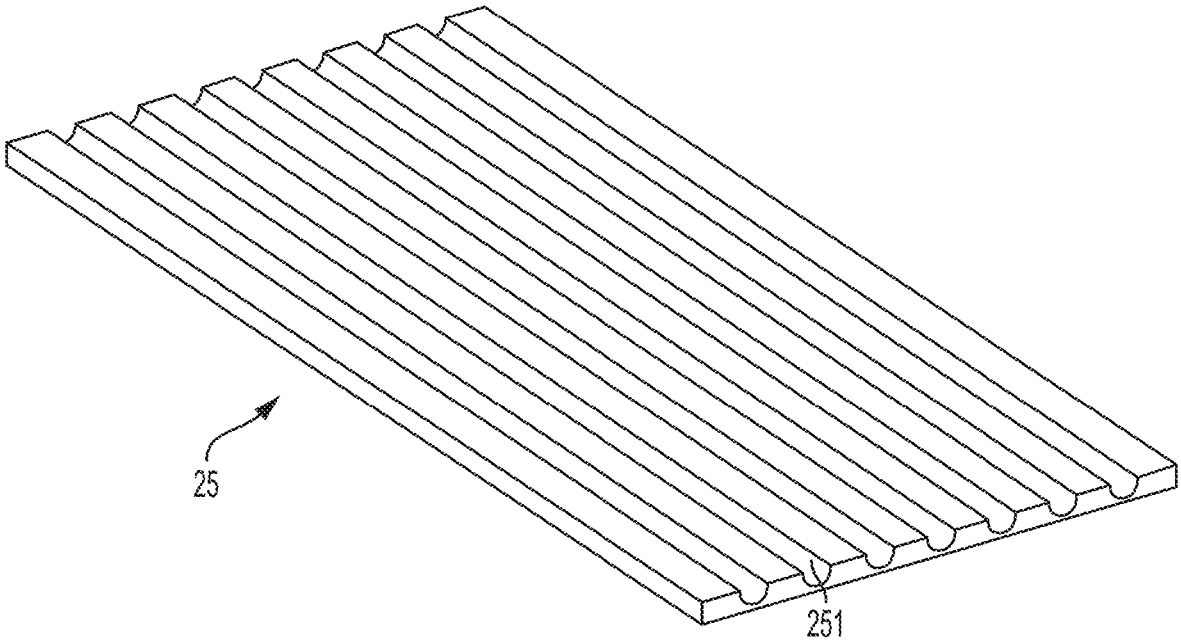
FIG. 72 shows a base plate for the FIG. 66 device.

While the FIG. 66 embodiment shows the condenser channel sets extending upwardly generally perpendicularly to the base plate 25, other arrangements are possible. For example, FIG. 70 shows a modification of the FIG. 66 embodiment in which the condensing channels 12 are arranged at an angle 9 relative to the vertical with the base plate 25 arranged horizontally. This arrangement allows the device 10 to operate in the horizontal orientation shown in FIG. 70, and a vertical orientation shown in FIG. 71 in which the base plate 25 is vertical, and other tilt angles between the horizontal and vertical. That is, the inclination angle of the condensing channels 12 ensures that the condensing channels 12 drain condensed liquid even when the device 10 is in the vertical position. Accordingly, the FIG. 70 arrangement is adapted for a variety of different orientations. Note that FIG. 72 shows a perspective view of the base plate 25 having grooves 251 to receive manifold sections 3 which may be thermally coupled to the base plate 25. The base plate 25 is not required, and can be omitted, or can be altered in size, shape and/or material. If the base plate 25 is omitted, the orientation of the device 10 may be referenced based on a plane of the manifold 3, e.g., a plane that passes through manifold sections engaged with condensing channel sets.

Figure 73:
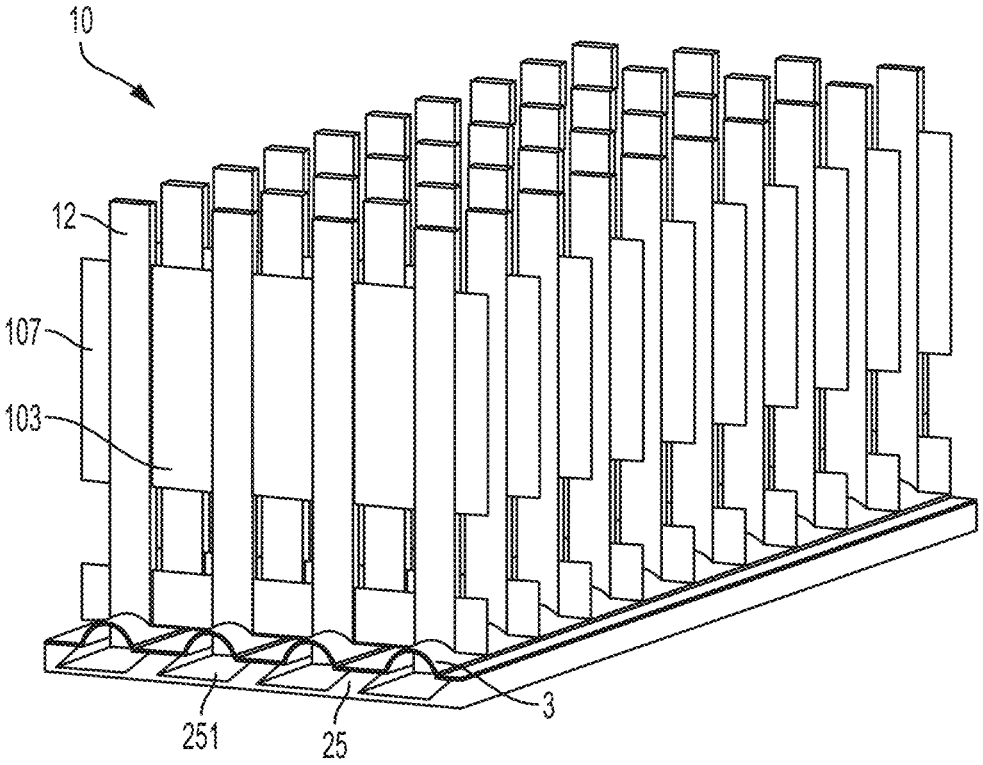
FIG. 73 shows a thermosiphon device including counterflow condenser channels arranged in a multiport tube structure and a multipart manifold.
Figure 74:
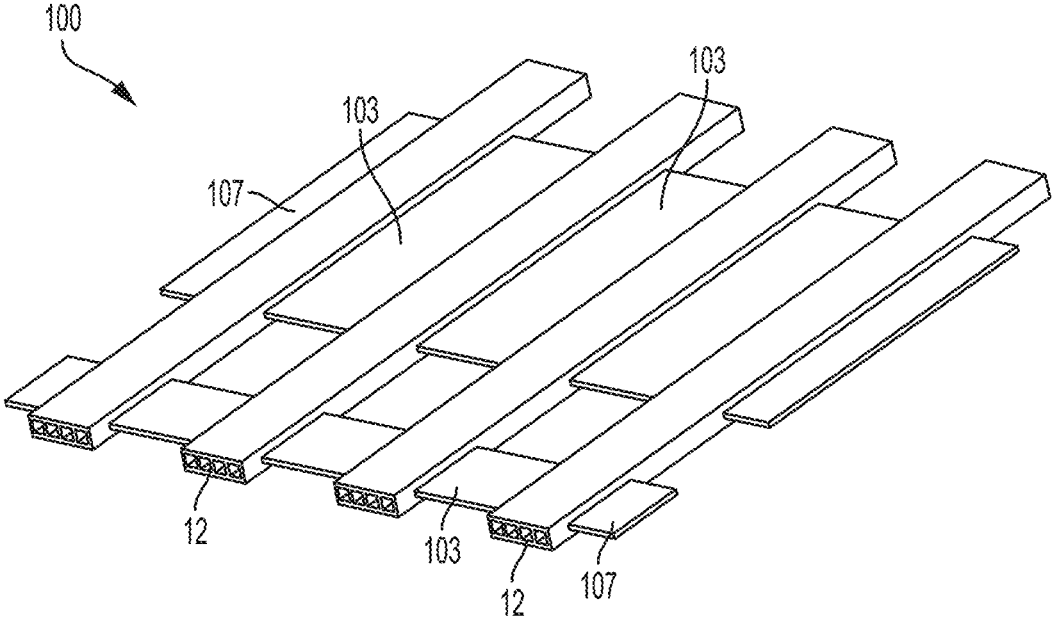
FIG. 74 shows a multiport tube structure for use in the FIG. 73 device.
Figure 75:
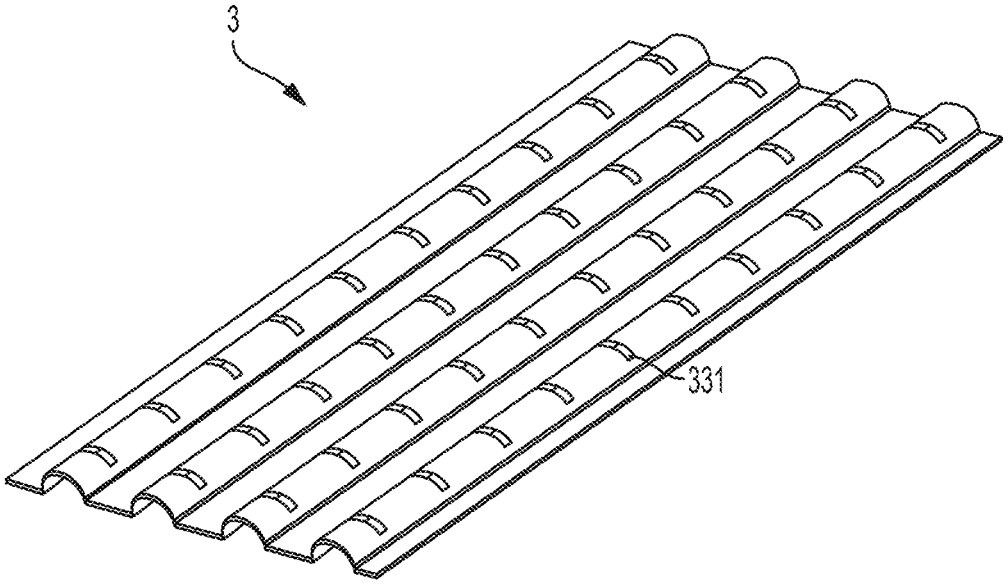
FIG. 75 shows a manifold sheet for the FIG. 73 device.
Figure 76:
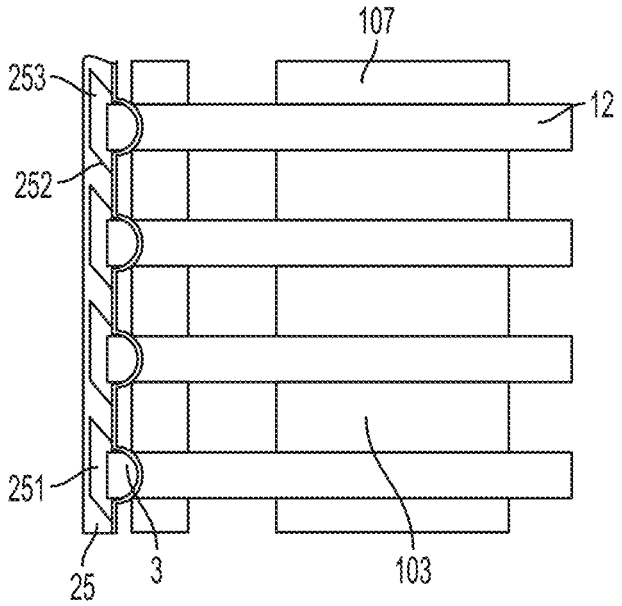
FIG. 76 shows the FIG. 73 device in a vertical orientation.
Figure 77:
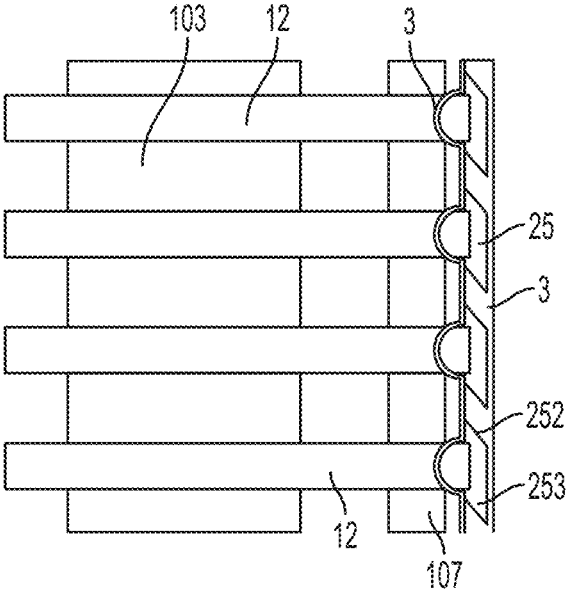
FIG. 77 shows the FIG. 73 device in an alternate vertical orientation.
Figure 78:
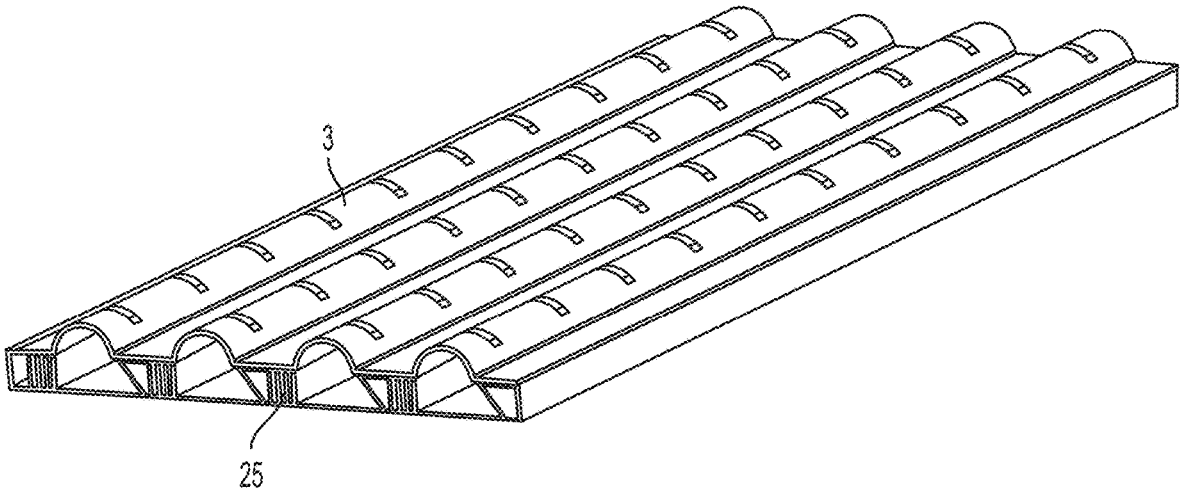
FIG. 78 shows an alternate manifold structure for the FIG. 73 device.
Figure 79:
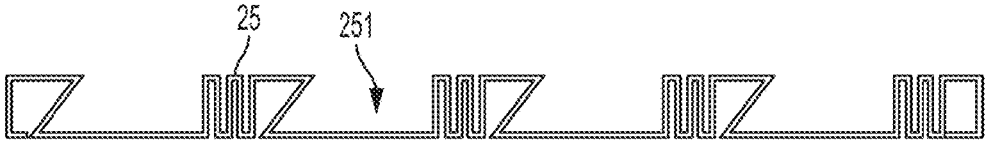
FIG. 79 shows a base plate for the FIG. 78 device.
Figure 80:
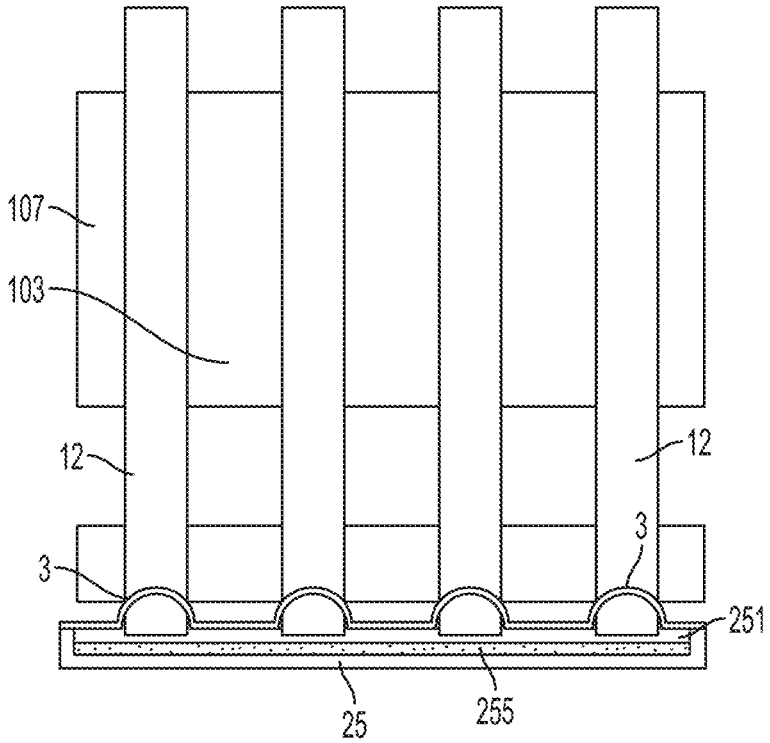
FIG. 80 shows an alternate manifold arrangement for the FIG. 73 device.

FIG. 73 shows another thermosiphon device 10 that can be operated in a variety of different orientations. This embodiment also includes a plurality of multiport tube structures 100 that each includes four sets of condensing channels 12 that are fluidly coupled at a bottom end to a manifold 3. A perspective view of a multiport tube structure 100 is shown in FIG. 74. The manifold 3 in this embodiment (see FIG. 75) includes a sheet with convex features having openings 331 to receive a condensing channel section of the multiport tube structure 100. The manifold sheet 3 is coupled to a base plate 25, which has channels 251 that correspond to the convex features. Together the sheet and the base plate 25 form a manifold with flow channels for working fluid. The FIG. 73 embodiment can operate in a horizontal orientation shown in FIG. 73, as well as a vertical orientation shown in FIG. 76. The device 10 operates in this orientation, in part, because the channels 251 are shaped and cooperate with the manifold sheet 3 so as to provide a cavity 252 adjacent the end of each condensing channel set to receive and hold liquid working fluid. (Without the cavities 252, the condensing channels 12 might flood with liquid, decreasing their effectiveness.) The device 10 can even operate when flipped over in a vertical orientation shown in FIG. 77. Again, the channels 251 are shaped and cooperate with the manifold sheet 3 to define a cavity 253 to receive and hold liquid, allowing the device to operate. While in these embodiments, the condensing channels 12 extend generally perpendicularly relative to the base plate 25, the condensing channel sets may extend at other angles relative to the plane of the base plate 25. Also, the base plate 25 may be arranged in other ways, e.g., as shown in FIGS. 78 and 79. In this embodiment, the base plate 25 is formed from a sheet that is bent to form the channels 251 and other structure of the base plate 25. FIG. 80 shows another modification in which the base plate 25 includes a single cavity 251 that spans multiple convex features of the manifold sheet 3. To aid in desirably moving liquid working fluid in the cavity 251, a wicking element 255 is provided, e.g., to help distribute fluid by wicking and/or to increase a surface area of the working fluid and enhance boiling.

Figure 81:
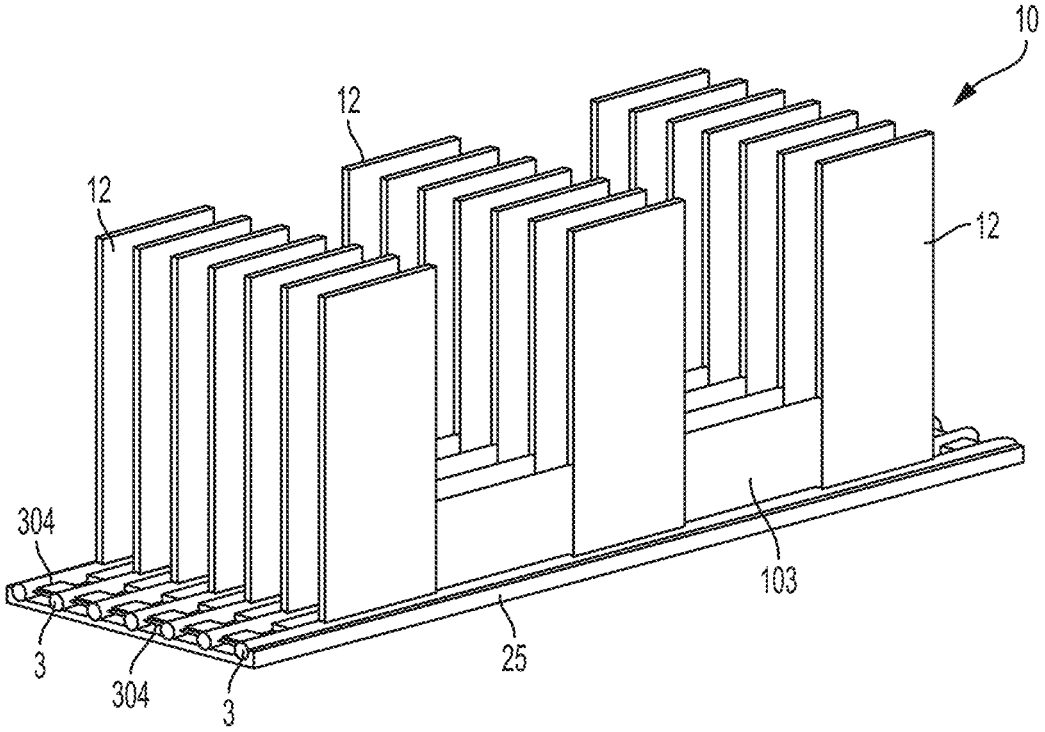
FIG. 81 shows a modified version of the FIG. 66 device with manifolds attached via a multiport tube conduit.
Figure 82:
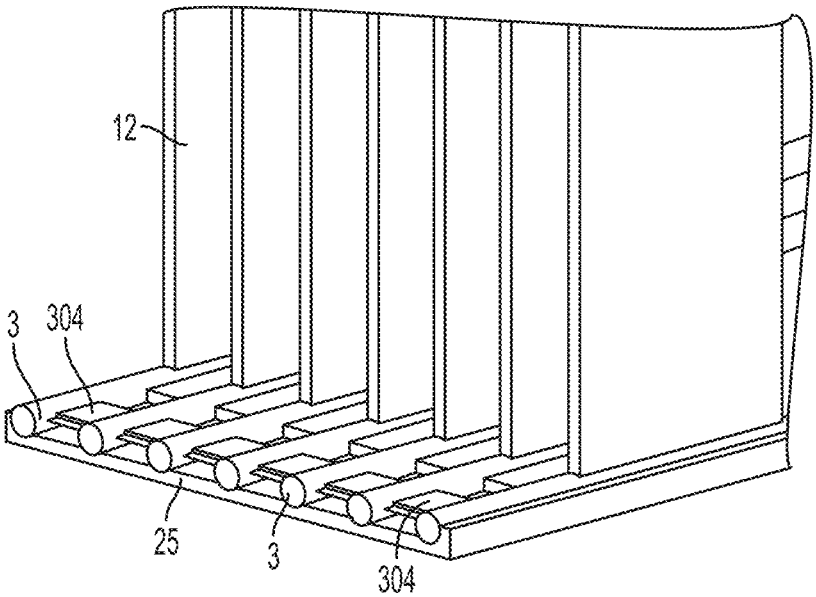
FIG. 82 shows a close up view of a portion of the FIG. 81 device.
Figure 83:
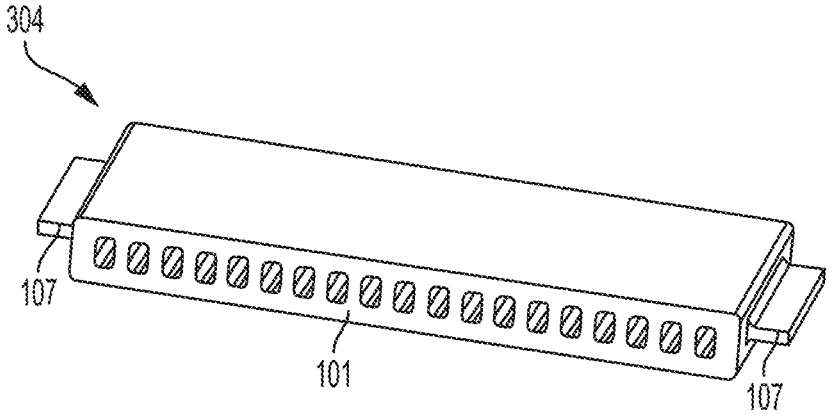
FIG. 83 shows a multiport tube conduit for use in the FIG. 81 device.
Figure 84:
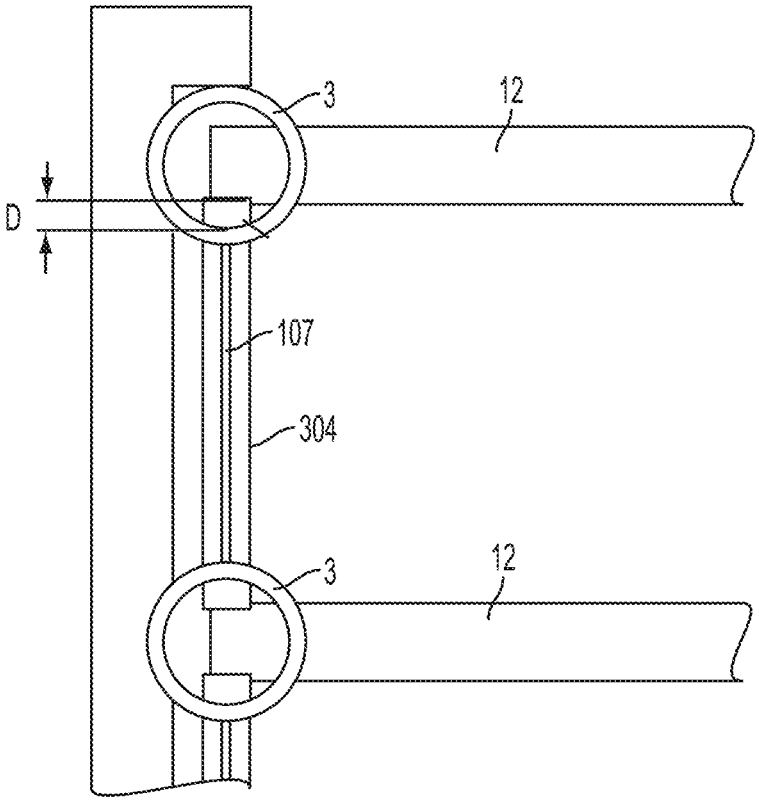
FIG. 84 shows a close up view of a multiport tube conduit engagement with manifolds in the FIG. 81 device.

FIG. 81 shows a thermosiphon device 10 that is similar to that in FIG. 66 with the major difference being that the manifold sections 3 are fluidly coupled by conduits 304 rather than bends 301. A close up view of the conduits 304 is shown in FIG. 82, and the conduits 304 may be arranged as shown in FIG. 83, e.g., as a multiport tube structure 100 with a first section 101 defining one or more flow channels and a pair of webs 107 extending outwardly from the first section 101. The webs 107 may help define an insertion depth of the conduits 304 into the manifold sections 3. FIG. 84 shows a close up view of a conduit 304 and how the webs 107 define an insertion depth D into a manifold section 3. This insertion depth D may help trap working fluid liquid in manifold sections 3 when the device is tilted, e.g., to a vertical position as shown in FIG. 84, thereby helping keep the device 10 in efficient operation even in a tilted orientation.

Figure 85:
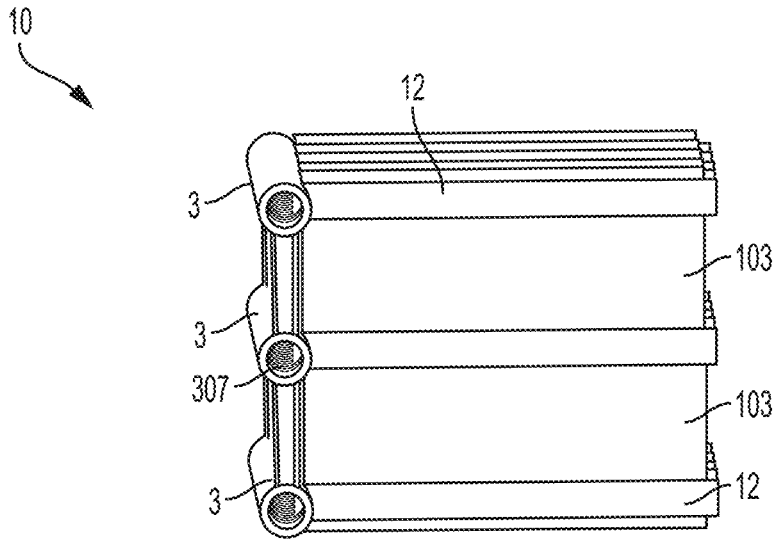
FIG. 85 shows an alternate liquid trapping arrangement including internal threads.
Figure 86:
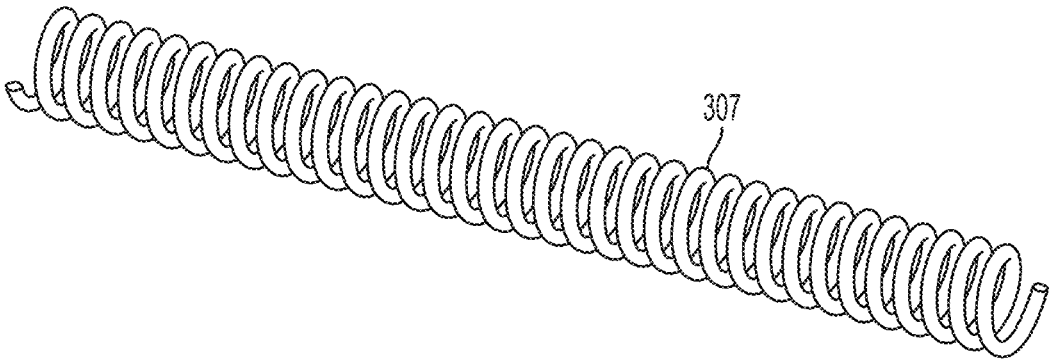
FIG. 86 shows a coil element for use in liquid trapping in a manifold.

FIG. 85 shows another arrangement to help trap liquid in a manifold 3. In this embodiment, the inner wall of the manifold 3 includes an internal thread feature 307 that helps trap liquid in the manifold 3, e.g., in the thread grooves. Thus, the thread feature 307 may help keep a manifold section from completely draining, thereby making working fluid liquid available for evaporation and heat transfer. In another illustrative embodiment, the internal thread feature 307 may be provided by a coil element, such as that shown in FIG. 86, rather than a thread groove formed in the inner wall of the manifold 3. The coil element may be brazed or otherwise secured in place, or held by friction or interference fit in the manifold 3. A brazed, adhered or other similar connection may aid in preventing liquid flow in any space between the coil element and the inner wall of the manifold 3. The additional surface area of the thread or coil feature exposed to the liquid may enhance heat transfer.

Figure 87:
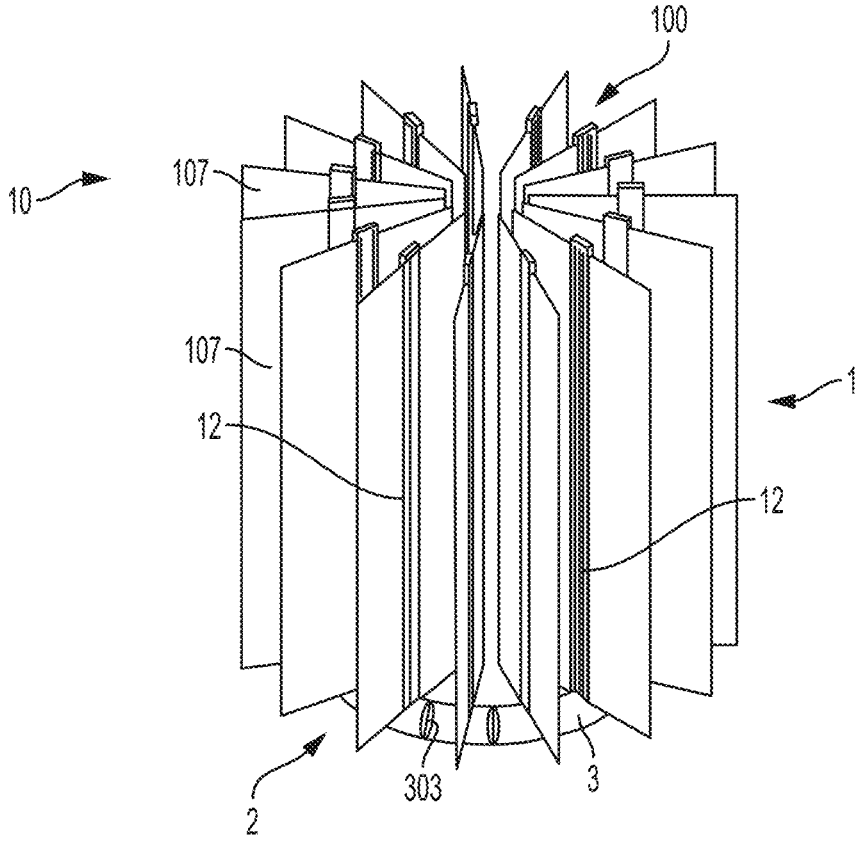
FIG. 87 shows a thermosiphon device having multiple, vertically oriented multiport tube structures including counterflow condenser channels.
Figure 88:
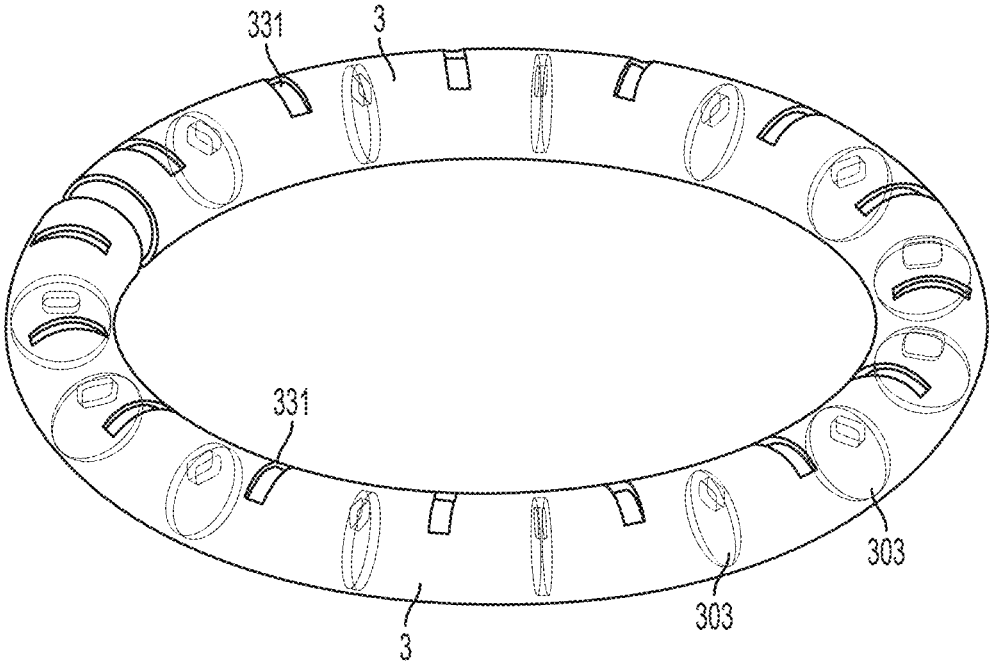
FIG. 88 shows a circular manifold of the FIG. 87 device.
Figure 89:
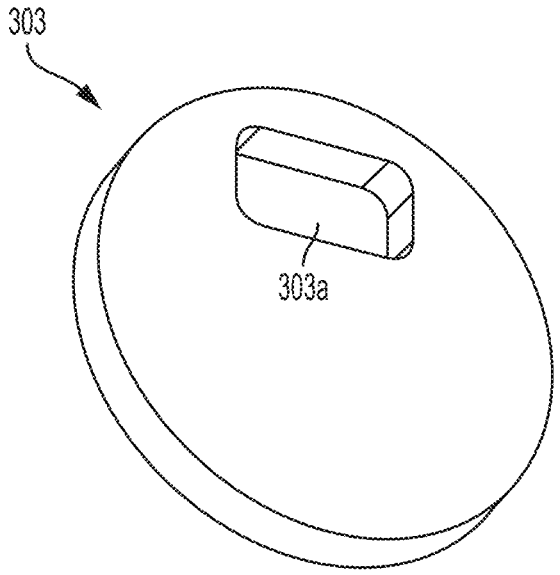
FIG. 89 shows a plug for use in the manifold of the FIG. 87 device.
Figure 90:
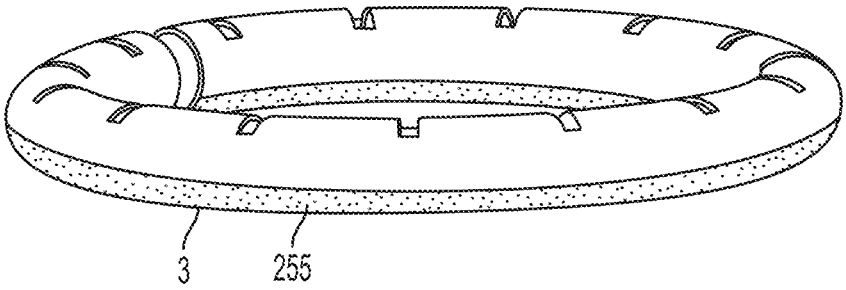
FIG. 90 shows an alternate manifold arrangement for the FIG. 87 device including a wicking element.

FIG. 87 shows another thermosiphon device 10 that is similar in operation to the FIG. 66 embodiment in that a plurality of condensing channel sets operate in a counterflow mode. However, in this embodiment, the manifold 3 has a circular tube, and the condensing channels are arranged in a multiport tube structure like that shown in FIG. 38. Also, the manifold 3 includes a plurality of plugs 303 that help trap working fluid liquid in desired areas of the manifold 3, e.g., at or near the condensing channels 12 of each multiport tube structure 100. FIG. 88 shows the manifold 3 alone with plugs 303 positioned between each opening 331 to receive a corresponding manifold end of a multiport tube structure 100. FIG. 89 shows a plug 303 with an opening 303*a*. The plug 303 is positioned in the manifold 3 so that the opening 303*a* is positioned to control a depth of liquid in the manifold in adjacent sections. In an alternative embodiment shown in FIG. 90, the plugs 303 may be replaced with a wicking element 255 that functions to encourage flow of liquid in the manifold 3.

Figure 91:
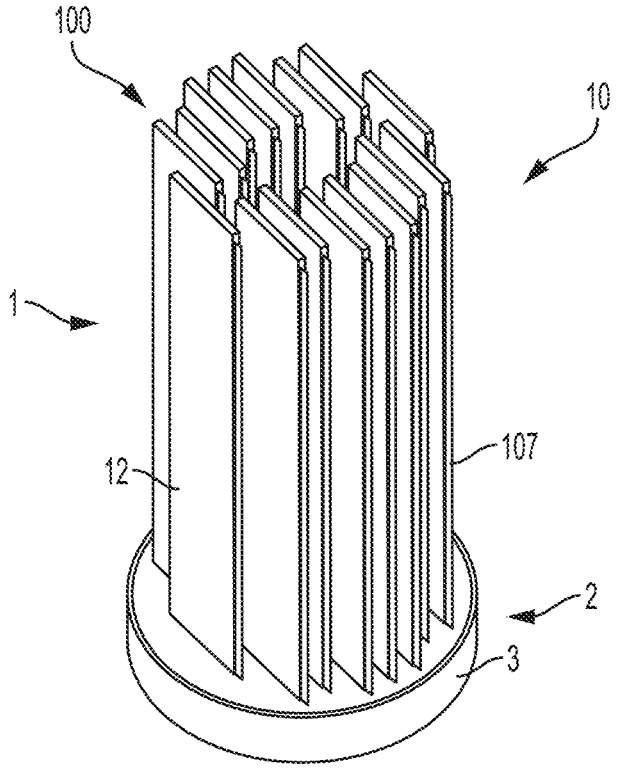
FIG. 91 shows a thermosiphon device similar to the FIG. 87 device and having a manifold with a cylindrical chamber.
Figure 92:
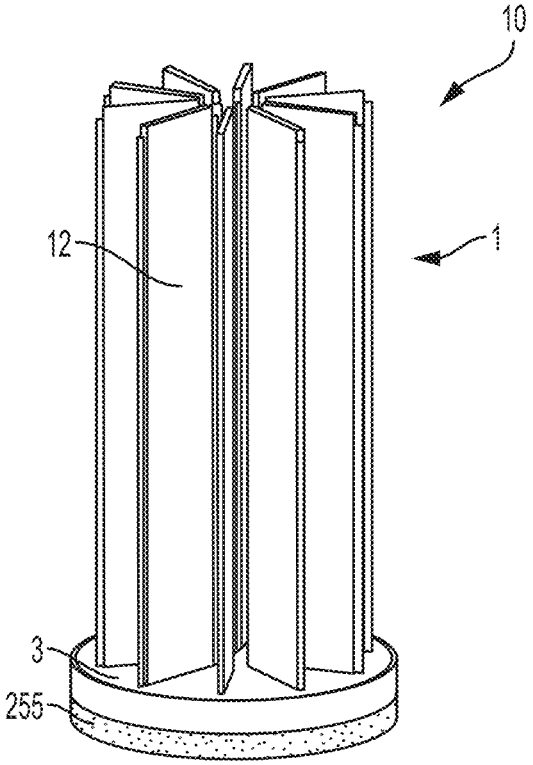
FIG. 92 shows an alternate manifold arrangement for the FIG. 91 device including a wicking element.
Figure 93:
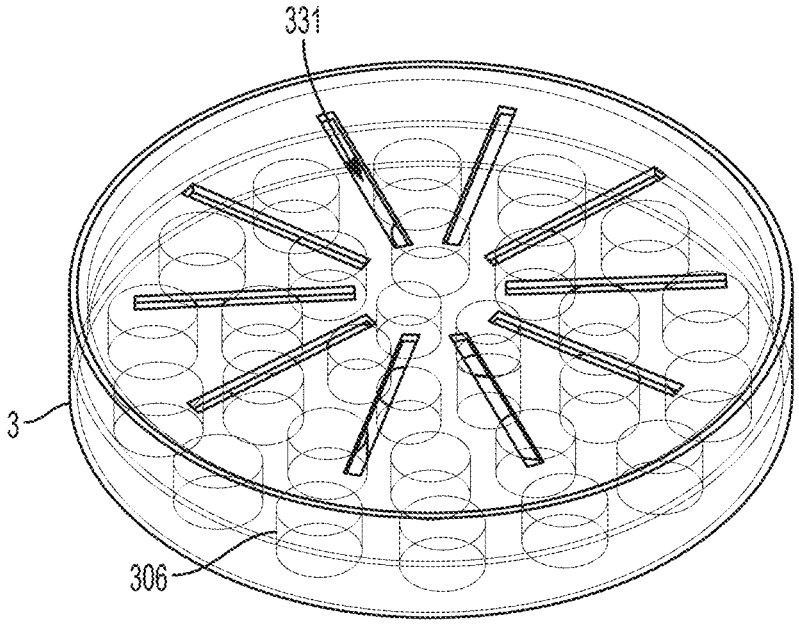
FIG. 93 shows alternate manifold arrangement for the FIG. 87 device including a plurality of cavities in the manifold bottom wall.

FIG. 91 shows another illustrative embodiment of a thermosiphon device 10 that operates similarly to that in FIG. 87, except that the circular manifold 3 is replaced with a manifold 3 having a cylindrical chamber shape. As can be seen in FIG. 92, the manifold 3 may include a wicking element 255 to encourage and spread flow of the liquid working fluid in the manifold 3. Alternately, as shown in FIG. 93, the manifold 3 may include a plurality of cavities 306 at a bottom of the manifold 3 to hold working fluid liquid. The cavities 306 may increase a surface area exposed to the liquid, thereby enhancing heat transfer. The working fluid liquid level in the manifold 3 may be maintained above a top level of the cavities 306 to ensure that the cavities 306 are all filled with liquid.

Figure 94:
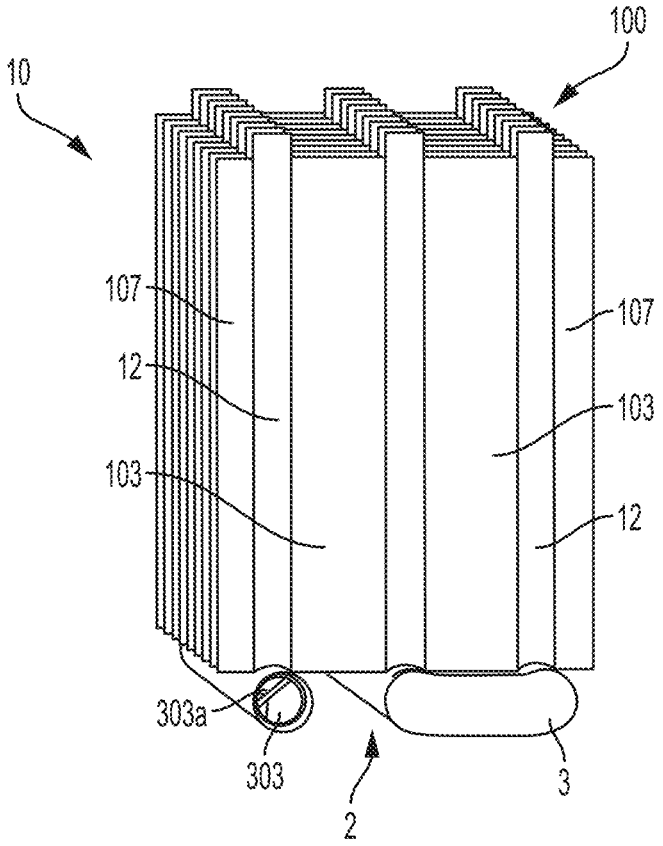
FIG. 94 shows a thermosiphon device with multiple, vertically oriented multiport tube structures including counterflow condenser channels and a serpentine manifold.
Figure 95:
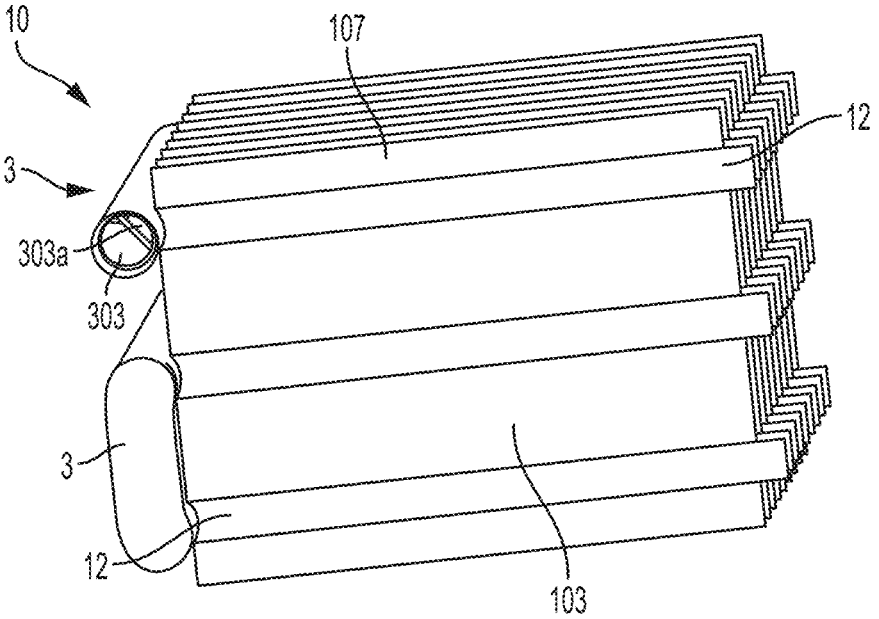
FIG. 95 shows the FIG. 94 device in a vertical orientation.

FIG. 94 shows yet another embodiment of a thermosiphon device 10 that includes a plurality of multiport tube structures with sections to define sets of condensing channels 12. In this case, each multiport tube structure 100 has three sections that define condensing channels 12, and adjacent sections are joined by a web 103. The manifold 3 is arranged as a bent tube and includes one or more plugs 303 with openings 303*a* positioned to trap liquid in desired sections of the manifold at a desired level. As in other embodiments, the manifold 3 has openings to receive a manifold end of each condenser channel set, and the webs 107 and/or 103 may help define an insertion depth of the manifold ends into the manifold. Plugs 303 may be positioned in the manifold 3 between each condensing channel set, and may be arranged to trap liquid so that the device 10 can operate properly even when tilted through a wide variety of angles and in a wide variety of directions. In fact, the device 10 may operate in a vertical orientation as shown in FIG. 94, at a horizontal orientation shown in FIG. 95, or other orientations in between.

The embodiments provided herein are not intended to be exhaustive or to limit the invention to a precise form disclosed, and many modifications and variations are possible in light of the above teachings. The embodiments were chosen and described in order to best explain the principles of the invention and its practical application to thereby enable others skilled in the art to best utilize the invention in various embodiments and with various modifications as are suited to the particular use contemplated. Although the above description contains many specifications, these should not be construed as limitations on the scope of the invention, but rather as an exemplification of alternative embodiments thereof.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

The use of "including," "comprising," "having," "containing," "involving," and/or variations thereof herein, is meant to encompass the items listed thereafter and equivalents thereof as well as additional items.

It should also be understood that, unless clearly indicated to the contrary, in any methods claimed herein that include more than one step or act, the order of the steps or acts of the method is not necessarily limited to the order in which the steps or acts of the method are recited.

While aspects of the invention have been described with reference to various illustrative embodiments, such aspects are not limited to the embodiments described. Thus, it is evident that many alternatives, modifications, and variations of the embodiments described will be apparent to those skilled in the art. Accordingly, embodiments as set forth herein are intended to be illustrative, not limiting. Various changes may be made without departing from the spirit of aspects of the invention.

The invention claimed is:

1. A thermosiphon device including:

an evaporator section arranged to receive heat and evaporate a liquid; and a condenser section arranged to transfer heat from evaporated liquid to a surrounding environment to condense the evaporated liquid;

the device comprising at least one flat multiport tube structure having a first section defining one or more flow channels, a second section defining one or more flow channels, and a web that extends between the first and second sections in a plane of the flat multiport tube structure, the web having a thickness in a direction perpendicular to the plane of the flat multiport tube structure that is less than a thickness of the first and second sections each defining one or more flow channels, wherein the first section defines a plurality of condensing channels, and the second section defines a vapor supply path of the condenser section.

2. A thermosiphon device including:

an evaporator section arranged to receive heat and evaporate a liquid; and a condenser section arranged to transfer heat from evaporated liquid to a surrounding environment to condense the evaporated liquid;

the device comprising at least one flat multiport tube structure having a first section defining one or more flow channels, a second section defining one or more flow channels, and a web that extends between the first and second sections in a plane of the flat multiport tube structure, the web having a thickness in a direction perpendicular to the plane of the flat multiport tube structure that is less than a thickness of the first and second sections each defining one or more flow channels, wherein the evaporator section includes at least one evaporation channel arranged to receive heat and evaporate a liquid in the at least one evaporation channel and a liquid return path for delivering condensed liquid to the at least one evaporation channel; and the condenser section includes at least one condensing channel arranged to transfer heat from evaporated liquid to a surrounding environment to condense the evaporated liquid and a vapor supply path for delivering evaporated liquid to the at least one condensing channel;

wherein the at least one evaporation channel and the liquid return path are part of a flat multiport tube structure in which the first section defines the at least one evaporation channel and the second section defines the liquid return path, and wherein the at least one condensing channel and the vapor supply path are part of a flat multiport tube structure in which the first section defines at least one condensing channel and the second section defines the vapor supply path.

3. The device of claim 2, further comprising at least one manifold fluidly connecting the at least one evaporation channel with the vapor supply path and fluidly connecting the at least one condensing channel with the liquid return path.

4. The device of claim 3, wherein the manifold includes an outer wall that defines an interior cavity and a separation wall positioned in the interior cavity to define and fluidly separate a vapor chamber and a liquid chamber in the interior cavity.

5. The device of claim 4, wherein the outer wall includes separate respective openings to receive a manifold end of the first section defining the at least one evaporation channel, the second section defining the liquid return path, the first section defining the at least one condensing channel and the second section defining the vapor supply path.

6. The device of claim 5, wherein the separation wall is positioned in the manifold such that the at least one evaporation channel is in fluid communication with the vapor chamber and the liquid return path is in fluid communication with the liquid chamber.

7. The device of claim 6, wherein the separation wall is positioned such that the at least one condensing channel is in fluid communication with the liquid chamber and the vapor supply path is in fluid communication with the vapor chamber.

8. The device of claim 5, wherein the device includes a first plurality of flat multiport tube structures that each include a first section that defines at least one evaporation channel and a second section defines the liquid return path, and a second plurality of flat multiport tube structures that each include a first section that defines at least one condensing channel and a second section defines the vapor supply path.

9. The device of claim 8, wherein the separation wall is positioned such that the evaporation channels of the first plurality of flat multiport tube structures are in fluid communication with the vapor chamber and the liquid return paths of the first plurality of flat multiport tube structures are in fluid communication with the liquid chamber.

10. The device of claim 9, wherein the separation wall is positioned such that the condensing channels of the second plurality of flat multiport tube structures are in fluid communication with the liquid chamber and the vapor supply paths of the second plurality of flat multiport tube structures are in fluid communication with the vapor chamber.

11. The device of claim 1, wherein the evaporator section includes at least one evaporation channel arranged to receive heat and evaporate a liquid in the at least one evaporation channel and a liquid return path for delivering condensed liquid to the at least one evaporation channel; and wherein a single flat multiport tube structure includes the second section that defines the at least one evaporation channel and the vapor supply path.

12. The device of claim 11, comprising a plurality of flat multiport tube structures that each include a second section that defines at least one evaporation channel and a vapor supply path, and a first section that defines a liquid return path and at least one condensing channel.

13. The device of claim 1, wherein the flat multiport tube structure includes a lateral web that extends outwardly from the first or second section in a plane of the flat multiport tube structure.

14. The device of claim 1, wherein the multiport tube structure further comprises a third section that defines a plurality of condenser channels and a second web that extends between the second and third sections in a plane of the multiport tube structure.

15. The device of claim 14, wherein the multiport tube structure further comprises a lateral web that that extends outwardly from the first or third section in a plane of the flat multiport tube structure.

16. The device of claim 14, further comprising a plurality of the multiport tube structures, an upper manifold that fluidly couples upper ends of the first, second and third sections of the multiport tube structures, and a lower manifold that fluidly couples lower ends of the first, second and third sections of the multiport tube structures.

17. The device of claim 1, further comprising a manifold fluidly connected to a manifold end of the first and second sections, and wherein a portion of the web at the manifold end acts as a stop to limit an insertion depth of the manifold end into the manifold.

18. A thermosiphon cooling device including:

an evaporator section arranged to receive heat and evaporate a liquid; and a condenser section arranged to transfer heat from evaporated liquid to a surrounding environment to condense the evaporated liquid;

the device comprising at least one flat multiport tube structure having a first section defining one or more flow channels, and a web that extends laterally away from the first section in a plane of the flat multiport tube structure, the web having a thickness in a direction perpendicular to the plane of the flat multiport tube structure that is less than a thickness of the first section defining one or more flow channels, wherein the first section defines a plurality of condensing channels, and the evaporator section includes a multiport tube structure that defines a plurality of evaporation channels, the device further comprising a vapor supply path and a liquid return path fluidly coupling the plurality of condensing channels and the plurality of evaporation channels.

19. The device of claim 18, further comprising a manifold fluidly coupling the plurality of evaporation channels and the condenser section.

20. The device of claim 18, further comprising a manifold fluidly coupling the plurality of condensing channels and the evaporator section.

21. The device of claim 18, comprising first and second webs that extend laterally away from opposite sides of the first section in a plane of the multiport tube structure.

22. The device of claim 18, further comprising a manifold fluidly coupled to a manifold end of the first section, wherein a portion of the web at the manifold end acts as stop to limit an insertion depth of the manifold end into the manifold.

23. The device of claim 18, comprising a plurality of multiport tube structures that each include a first section defining a plurality of condensing channels, the device further comprising a manifold fluidly coupling manifold ends of the first sections of the plurality of multiport tube structures and the evaporator section.

24. The device of claim 23, further comprising a turnaround fluidly coupling upper ends of the first sections of the plurality of multiport tube structures.

25. The device of claim 24, wherein the evaporator section includes a plurality of multiport tube structures that each include a first section defining a plurality of evaporation channels, a manifold end of the multiport tube structures being fluidly coupled to the manifold.

26. The device of claim 18, comprising a first multiport tube structure having a first section defining a plurality of evaporation channels of the evaporator section and a vapor supply path of the condenser section, and a second multiport tube structure having a first section defining a plurality of condensing channels of the condenser section and a liquid return path of the evaporator section.

27. The device of claim 26, comprising thermal transfer structure attached to the first multiport tube structure only at a portion of the first section that functions as a plurality of evaporation channels, and thermal transfer structure attached to the second multiport tube structure only at a portion of the first section that functions as a plurality of condenser channels.

28. The device of claim 26, comprising an upper turnaround that fluidly couples an upper end of the first multiport tube structure to an upper end of the second multiport tube structure, and a lower turnaround that couples a lower end of the first multiport tube structure to a lower end of the second multiport tube structure.

29. The device of claim 28, wherein the upper or lower turnaround is formed by a manifold or a bend in the multiport tube structures.

30. The device of claim 18, wherein the vapor supply path, liquid return path and the plurality of evaporation channels are formed as part a single multiport tube structure.

31. The device of claim 18, further comprising manifolds fluidly coupled to the first section at opposite ends of the multiport tube structure.

* * * * *